US011460013B2

(12) United States Patent
Chu

(10) Patent No.: US 11,460,013 B2
(45) Date of Patent: Oct. 4, 2022

(54) BENT AXIS HYDRAULIC PUMP WITH CENTRIFUGAL ASSIST

(71) Applicant: Parker-Hannifin Corporation, Cleveland, OH (US)

(72) Inventor: Yu-Sen J. Chu, Westlake, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 224 days.

(21) Appl. No.: 16/757,995

(22) PCT Filed: Nov. 15, 2018

(86) PCT No.: PCT/US2018/061240
§ 371 (c)(1),
(2) Date: Apr. 21, 2020

(87) PCT Pub. No.: WO2019/103904
PCT Pub. Date: May 31, 2019

(65) Prior Publication Data

US 2020/0340463 A1 Oct. 29, 2020

Related U.S. Application Data

(60) Provisional application No. 62/589,678, filed on Nov. 22, 2017.

(51) Int. Cl.
*F04B 1/20* (2020.01)
*F04B 23/14* (2006.01)
(Continued)

(52) U.S. Cl.
CPC ..... *F04B 1/20* (2013.01); *F04B 1/2064* (2013.01); *F04B 1/24* (2013.01); *F04B 23/106* (2013.01); *F04B 23/14* (2013.01); *F04D 25/16* (2013.01)

(58) Field of Classification Search
CPC ..... F04B 23/14; F04B 23/106; F04B 1/20; F04B 1/2064; F04B 1/24; F04D 25/16
See application file for complete search history.

(56) References Cited

U.S. PATENT DOCUMENTS 2,769,393 A * 11/1956 Cardillo ..... F01B 3/0088 91/488
2,956,503 A 10/1960 Neidl
(Continued)

FOREIGN PATENT DOCUMENTS

GB 590199 A 7/1947
JP S6298778 U 6/1987

OTHER PUBLICATIONS

International Search Report and Written Opinion dated Jan. 28, 2019 for International Patent Application No. PCT/US2018/061240.

*Primary Examiner* — Christopher S Bobish
(74) *Attorney, Agent, or Firm* — Renner, Otto, Boisselle & Sklar, LLP

(57) ABSTRACT

A pump and motor assembly (20) includes a centrifugal pump (30), a bent axis hydraulic pump 58, and a wet-type drive motor (228). The motor has a rotor and a stator that are submerged in hydraulic fluid for full lubrication and cooling. A drive shaft 66 is driven by the motor. The centrifugal pump has a rotatable impeller (50) for pumping hydraulic fluid from an inlet (48) to the bent axis hydraulic pump. The centrifugal pump also pumps fluid to the motor for lubrication and cooling. The bent axis hydraulic pump pumps the fluid and discharges the fluid from the system. The centrifugal pump and the bent axis hydraulic pump are rotatable along a common rotational axis R1 that is angled relative to the rotational axis R2 of the drive shaft.

18 Claims, 21 Drawing Sheets

(51) Int. Cl.

| | |
|---|---|
| ***F04D 25/16*** | (2006.01) |
| ***F04B 23/10*** | (2006.01) |
| ***F04B 1/24*** | (2006.01) |
| ***F04B 1/2064*** | (2020.01) |

(56) References Cited

U.S. PATENT DOCUMENTS 3,202,101 A * 8/1965 Hedge ..... F04B 1/2064 415/68
3,672,793 A * 6/1972 Yowell ..... F04B 1/128 417/415
3,731,593 A * 5/1973 Chivari ..... F04B 1/2092 91/487
3,777,623 A * 12/1973 Bosch ..... F04B 1/2007 91/487
4,014,628 A * 3/1977 Ruseff ..... F04B 23/106 91/499
4,025,238 A * 5/1977 Masclet ..... F04B 1/2064 417/252
4,281,971 A * 8/1981 Kouns ..... F04B 23/14 417/205
4,793,774 A 12/1988 Bradt
4,999,020 A 3/1991 Stocco
5,220,225 A * 6/1993 Moon, Jr. ..... F04B 23/14 310/87
5,320,501 A * 6/1994 Langosch ..... H02K 9/19 417/357
5,501,578 A * 3/1996 Skirde ..... F04B 1/2085 417/206
9,080,549 B2 * 7/2015 Bergmann ..... F04B 1/2035
9,097,113 B2 * 8/2015 Miyata ..... F04B 1/24
10,995,751 B2 * 5/2021 Chu ..... F04C 15/0019
2003/0017057 A1 * 1/2003 Suzuki ..... F04B 23/106 417/206
2006/0034703 A1 * 2/2006 Fox ..... F04B 1/324 417/269
2013/0199362 A1 * 8/2013 Hoover ..... F01B 3/0032 91/499

* cited by examiner

BENT AXIS HYDRAULIC PUMP WITH CENTRIFUGAL ASSIST

This application is a national phase of International Application No. PCT/US2018/061240 filed Nov. 15, 2018 and published in the English language, which claims priority to U.S. Provisional Patent Application No. 62/589,678 filed Nov. 22, 2017, the entirety of both being hereby incorporated herein by reference.

FIELD OF INVENTION

The present invention relates to a bent axis hydraulic piston pump having a centrifugal pump that allows the bent axis piston pump to be operated at higher speeds to increase its flow performance.

BACKGROUND

Bent axis hydraulic piston pumps are known for their high pressure and high speed capability. However, in many applications, the pumps are not able to run at speeds that they are capable of due to the cavitation that results at high revolutions per minute (RPMs). These prior art bent axis hydraulic piston pumps may be inadequate for some applications in which it would be desirable to have a pump assembly that pumps larger amounts of fluid at higher pump speeds.

SUMMARY OF INVENTION

The present invention provides a pump and motor assembly having an integral centrifugal pump with a bent axis hydraulic piston pump. The combination of the centrifugal pump and the bent axis hydraulic pump is advantageous in that the entire pump assembly may be run at higher speeds and pump more fluid as compared with conventional pumps.

In exemplary embodiments, the centrifugal pump includes an impeller driven by a drive motor. Hydraulic fluid is taken in through the centrifugal pump and rotation of the impeller causes the hydraulic fluid to have an increased inlet pressure, or inlet pressure boos to the bent axis pump. The hydraulic fluid being pumped is collected in the centrifugal pump chamber and routed to the inlet of the bent axis hydraulic pump which may run at relatively high speeds. The fluid is then pumped by the bent axis hydraulic pump and discharged into the system. The assembly may additionally use a wet-type electric drive motor having a stator and rotor that are submerged in the fluid being pumped. The pumped fluid may be routed from the impeller discharge to the motor housing to provide full and uniform lubrication and cooling of the motor components enabling the motor to run efficiently during the high-speed operation of the pump assembly.

In other exemplary embodiments, the pump and motor assembly is suitable for applications that require bidirectional fluid flow by providing an additional impeller and a discharge port at the motor side of the pump and motor assembly. During a forward flow operation of the assembly, a low pressure fluid is taken in through the inlet of the centrifugal pump at the pump side and a high pressure fluid is discharged out of the assembly through the discharge port at the motor side. During a reverse flow operation, a low pressure fluid is taken in through the discharge port at the motor side and a high pressure fluid is discharged out of the assembly through the centrifugal pump inlet.

Providing the additional impeller advantageously enables a pressure boost of fluid flowing in either direction through the pump and motor assembly. The impellers are also rotatable in opposite rotational directions such that the fluid passing through both impellers receives a dual pressure boost. The pump and motor assembly further includes flow paths formed in the assembly that are configured to receive the high pressure fluid generated by the pump and motor assembly during operation. Check valves that each have a preset pressure are arranged along the flow paths to enable the low pressure fluid to flow through the motor for cooling while also preventing the high pressure fluid from reaching the motor during both forward flow operation and reverse flow operation.

According to one aspect of the invention, a pump assembly includes an inlet port, a discharge port, and a centrifugal pump assembly having a housing that defines an interior chamber in fluid communication with the inlet port, an outlet, and an impeller rotatable within the interior chamber. The impeller is connected to a rotatable drive shaft that rotates the impeller and the impeller pumps fluid from the inlet port to the outlet. The pump assembly includes a cylinder barrel and piston assembly rotationally coupled to the impeller and the drive shaft that is in fluid communication with the outlet of the centrifugal pump assembly. The cylinder barrel and piston assembly pumps hydraulic fluid toward the discharge port. The cylinder barrel and piston assembly and the centrifugal pump assembly are rotatable about a first rotational axis and the drive shaft is rotatable about a second rotational axis. The first rotational axis and the second rotational axis are angled relative to each other.

According to another aspect of the invention, a pump assembly includes a drive shaft and a centrifugal pump assembly including a centrifugal pump housing having an interior chamber and an impeller that is connected to the drive shaft and rotatable within the interior chamber of the centrifugal pump housing by rotation of the drive shaft. The pump assembly includes a cylinder barrel and piston assembly including a cylinder barrel housing that is integrated with the centrifugal pump housing, a cylinder barrel rotationally coupled to the impeller, and at least one piston that is moveable within the cylinder barrel and coupled to the drive shaft. The cylinder barrel and piston assembly is in fluid communication with the centrifugal pump housing. The cylinder barrel and piston assembly and the centrifugal pump assembly are rotatable about a first rotational axis and the drive shaft is rotatable about a second rotational axis. The first rotational axis and the second rotational axis are angled relative to each other. The cylinder barrel housing includes a cylindrical main body that is arranged along the first rotational axis and a flange wall that is secured to the cylindrical main body and arranged along the second rotational axis.

According to another aspect of the invention, a pump and motor assembly includes a motor housing defining a motor chamber, a motor having a rotor and a stator that are arranged within the motor chamber and submerged in hydraulic fluid, and a drive shaft driven by the motor. The pump and motor assembly includes a centrifugal pump assembly including a centrifugal pump housing having an interior chamber, an inlet, and an outlet, an impeller rotatable within the interior chamber of the centrifugal pump housing, wherein the impeller pumps hydraulic fluid from the inlet to the outlet. The pump and motor housing includes a cylinder barrel and piston assembly rotationally coupled to the impeller and the drive shaft. The cylinder barrel and piston assembly is in fluid communication with the outlet of the centrifugal pump assembly and the cylinder barrel and piston assembly pumps hydraulic fluid received from the centrifugal pump assembly and discharges the fluid to the pump outlet. The centrifugal pump assembly and the cylinder barrel and piston assembly are rotatable about a first rotational axis and the drive shaft and the motor assembly are rotatable about a second rotational axis. The first rotational axis and the second rotational axis are angled relative to each other.

According to another aspect of the invention, the pump and motor assembly includes a motor side impeller that is in fluid communication with the impeller of the centrifugal pump assembly and rotatable about the second rotational axis in an opposite rotational direction relative to a rotational direction of the impeller of the centrifugal pump assembly, and a discharge port in fluid communication with the motor side impeller. During a forward flow operation of the pump and motor assembly, the inlet of the centrifugal pump assembly is configured to intake a low pressure fluid into the pump and motor assembly and the discharge port is configured to discharge high pressure fluid out of the pump and motor assembly. During a reverse flow operation of the pump and motor assembly, the discharge port of the motor assembly is configured to intake a low pressure fluid into the pump and motor assembly and the inlet of the centrifugal pump assembly is configured to discharge a high pressure fluid out of the pump and motor assembly.

The foregoing and other features of the invention are hereinafter described in greater detail with reference to the accompanying drawings.

DETAILED DESCRIPTION

Figure 1:
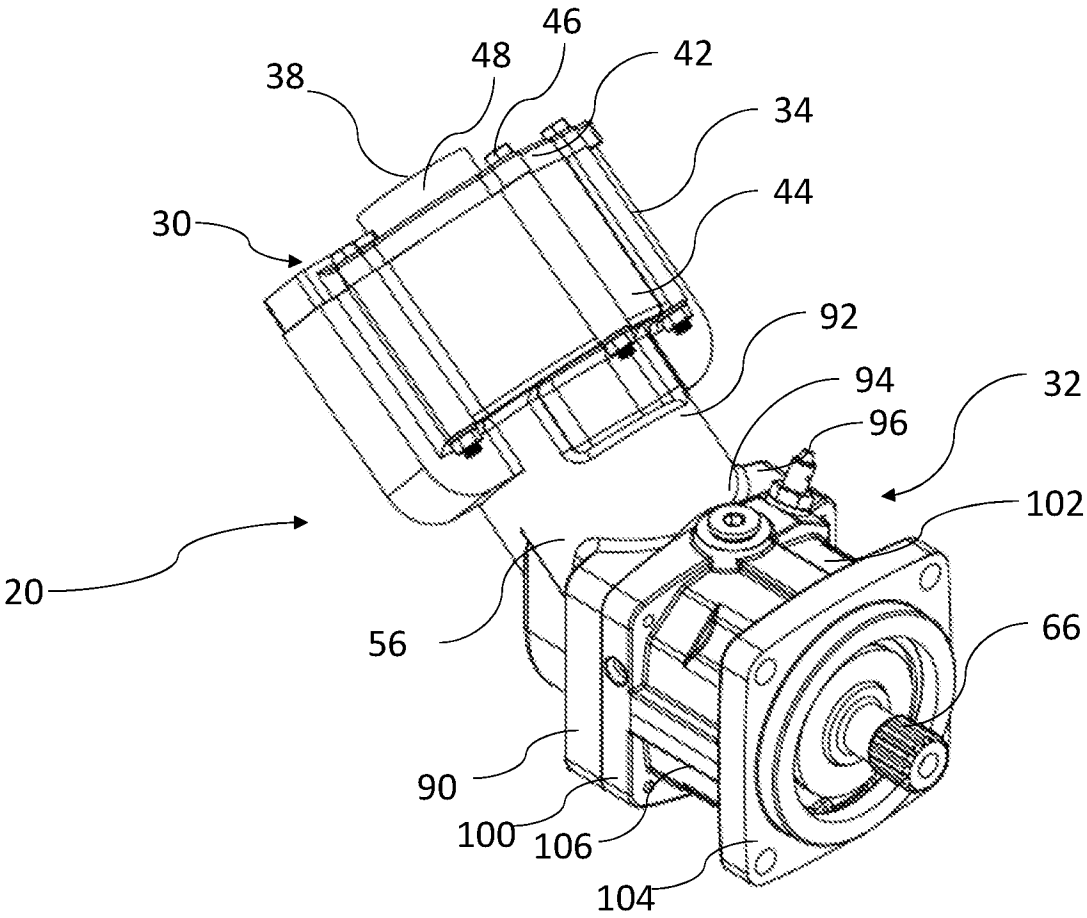
FIG. 1 is a perspective view of a pump assembly housing for a pump assembly having a centrifugal pump and a bent axis hydraulic pump in accordance with the present invention.
Figure 3:
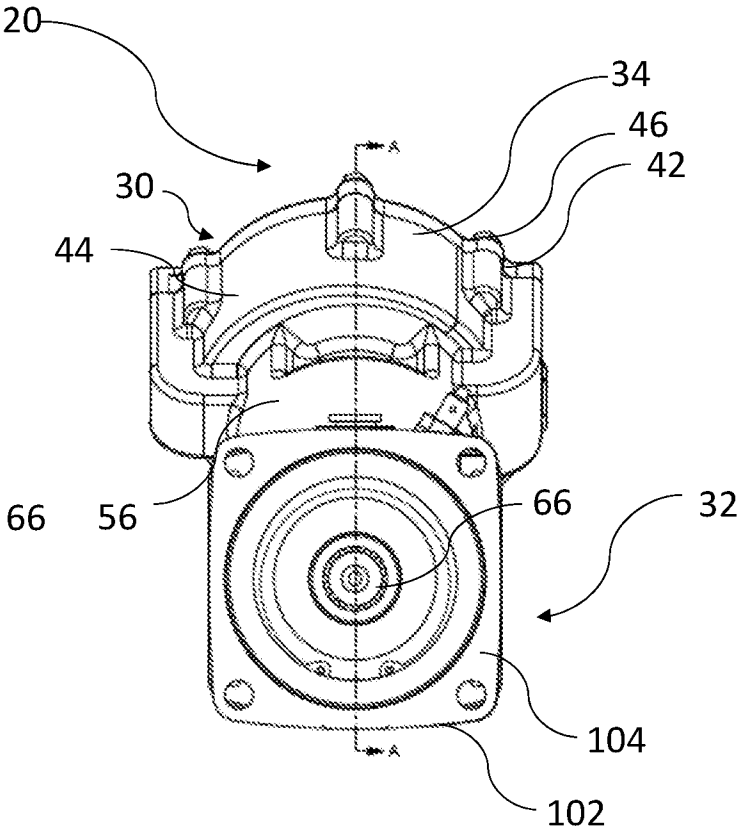
FIG. 3 is a top view of the pump assembly of FIG. 1.

The principles of the present invention may be suitable for use with pump assemblies used in high pressure applications. The pump assembly described herein may be suitable to provide pumping for stationary, mobile, and high vapor-pressure fluid applications. Examples of suitable applications may include oil and gas refining, offshore drilling, transportation refueling, aircraft refueling, mining, and chemical processing, hydraulic actuation and control.

Referring first to FIGS. 1-10, a pump assembly 20 includes a centrifugal pump assembly 30 and a bent axis hydraulic pump assembly 32. The centrifugal pump assembly 30 includes a centrifugal pump housing 34 having an interior chamber 36, an inlet 38, and an outlet 40. The centrifugal pump housing 34 includes a volute chamber cover 42 that is secured to a main body 44 of the centrifugal pump housing 34. The main body 44 defines the interior chamber 36 and the volute chamber cover 42 closes the interior chamber 36. The outlet 40 is defined within the main body 44. The volute chamber cover 42 has a small thickness relative to the main body 44 and may be secured to the end of the main body 44 using bolts 46 or any other suitable fastener. The volute chamber cover 42 may include a cylindrical inlet port 48 that defines the opening to the inlet 38 and extends axially outwardly from the volute chamber cover 42.

The centrifugal pump assembly 30 includes an impeller 50 that is mounted on and rotationally driven by an impeller shaft 52. The centrifugal pump assembly 30 may include a bronze thrust washer 54 arranged between the impeller 50 and the inlet port 48. The impeller 50 may be formed of any suitable material such as stainless steel which is durable and has the capability of handling vapor bubbles. The impeller 50 may be shrouded and the impeller blades are preferably optimized to be sharp, large, and smoothly machined to allow for faster acceleration of hydraulic fluid during rotation of the impeller 50. The rotating impeller 50 acts as a centrifugal pump to intake hydraulic fluid and pump the hydraulic fluid toward the bent axis hydraulic pump assembly 32, such that the centrifugal pump assembly 30 provides a pressure boost to the fluid at the inlet side of the bent axis hydraulic pump assembly 32. The centrifugal pump assembly 30 is arranged along a first rotational axis R1 (shown in FIG. 4) about which the impeller 50 and the impeller shaft 52 are rotatable.

The bent axis hydraulic pump assembly 32 includes a cylinder barrel housing 56 that is integrated with the centrifugal pump housing 34 and houses a cylinder barrel and piston assembly that is rotationally coupled to the impeller 50. The impeller 50 is rotatably positioned in between the housing 56 and the volute chamber cover 42. The bent axis hydraulic pump assembly 32 is arranged along the first rotational axis R1 and around the impeller shaft 50. The cylinder barrel housing 56 includes a cylinder barrel 58 that is rotatable about the first rotational axis R1. The bent axis hydraulic pump assembly 32 includes at least one piston 60 that is received within a bore 62 of the cylinder barrel 58. The bent axis hydraulic pump assembly 32 may include a plurality of pistons and bores. The cylinder barrel 58 includes at least one bore that is in fluid communication with the outlet 40 of the centrifugal pump assembly 30 and at least one bore that is in fluid communication with a discharge port to discharge the hydraulic fluid from the pump assembly 20 to the surrounding system.

Figure 4:
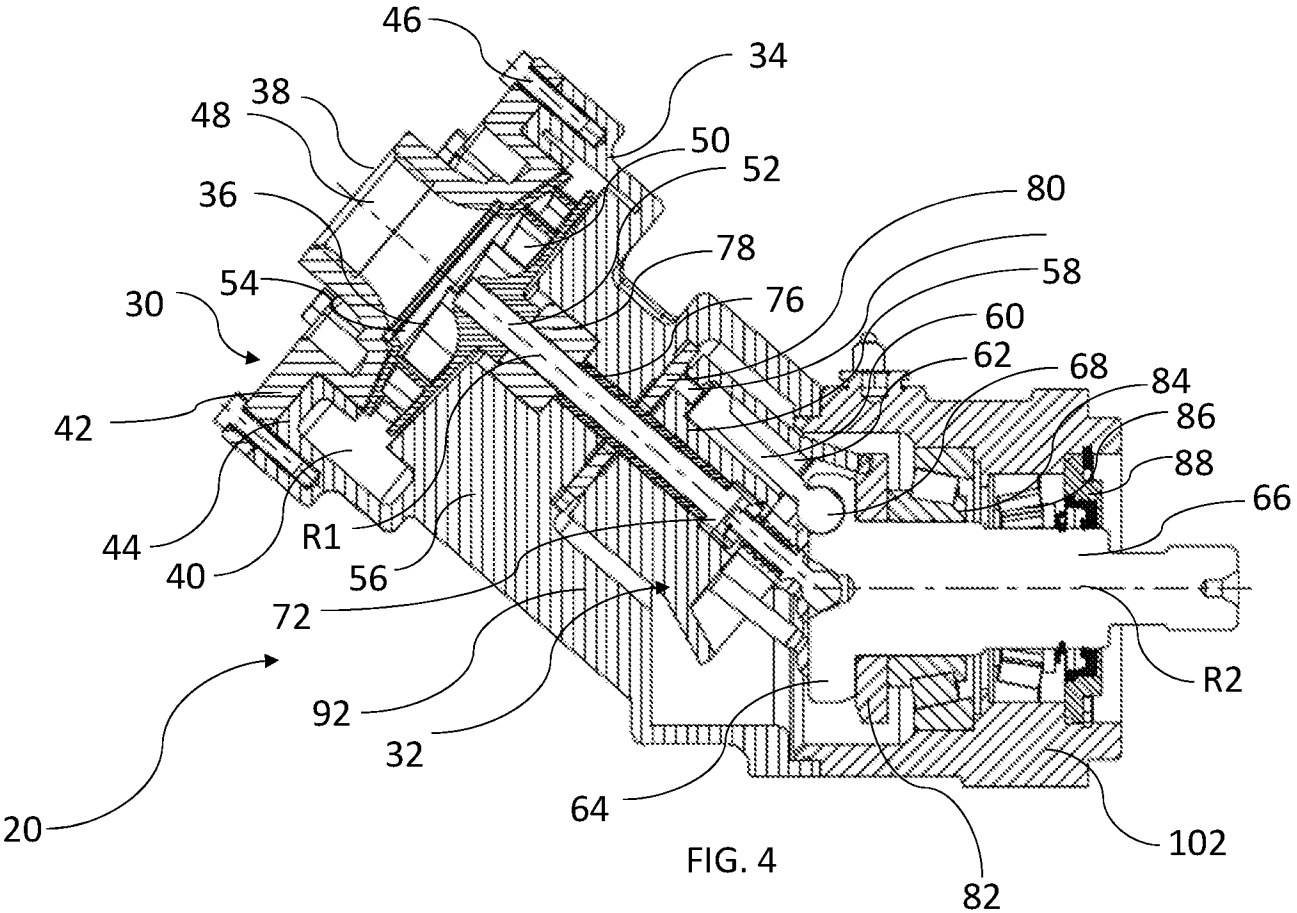
FIG. 4 is a sectional view of the pump assembly taken along line A-A of FIG. 3.

The piston 60 is coupled to a flange 64 of a rotatable drive shaft 66 through a ball and socket joint 68 that is rotatable about a second rotational axis R2 (shown in FIG. 4). The cylinder barrel 58 is rotationally coupled to the drive shaft 66 through bevel gears at the ends of a timing gear such that the cylinder barrel and piston assembly is rotationally coupled to the impeller 50 and the drive shaft 66. The first rotational axis R1 of the centrifugal pump assembly 30 and the second rotational axis R2 are angled relative to each other. The first rotational axis R1 and the second rotational axis R2 may be angled at any suitable angle. For example, the first rotational axis R1 may be angled upwardly from the second rotational axis R2 at angles between 0° and 45°. The first rotational axis R1 may be angled upwardly from the second rotational axis at an angle that is approximately 40°. The ball and socket joint 68 may secure the piston 60 within the flange 64 of the drive shaft 66. The impeller shaft 52 extends through the cylinder barrel 58 and is secured to the cylinder barrel 58 for rotation therewith. The impeller shaft 52 may have an end portion 72 that extends to engage an interior wall of the cylinder barrel 58.

A hollow guide pin 76 may be arranged on the impeller shaft 52 and surrounds at least part of the impeller shaft 52 to enable rotation of the impeller shaft 52 relative to the cylinder barrel housing 56. The guide pin 76 is anchored to the cylinder barrel housing 56 and extends through the cylinder barrel 58. A bushing spacer 78 is also anchored within the barrel housing 56 towards the interior chamber 36 to support the impeller shaft 52. The bushing spacer 78 is engageable against an end of the impeller 50 to hold the impeller 50 at a predetermined axial position within the interior chamber 36. The cylinder barrel 58 and piston assembly further includes a slotted valve plate 80 that is arranged in between the cylinder barrel 58 and the cylinder barrel housing 56. The slotted valve plate 80 includes a plurality of fluid passages. Half of the fluid passages are connected with the downstream flow path of the centrifugal pump assembly 30 and the other half of the fluid passages are connected to the discharge side of the piston assembly in the barrel housing 56. The cylinder barrel 58 is rotationally coupled to the drive shaft 66 through the timing gear 82. The bent axis hydraulic pump assembly 32 may further include tapered roller bearings 84, 86 and a shaft seal 88 that are arranged on the drive shaft 66.

Figure 2:
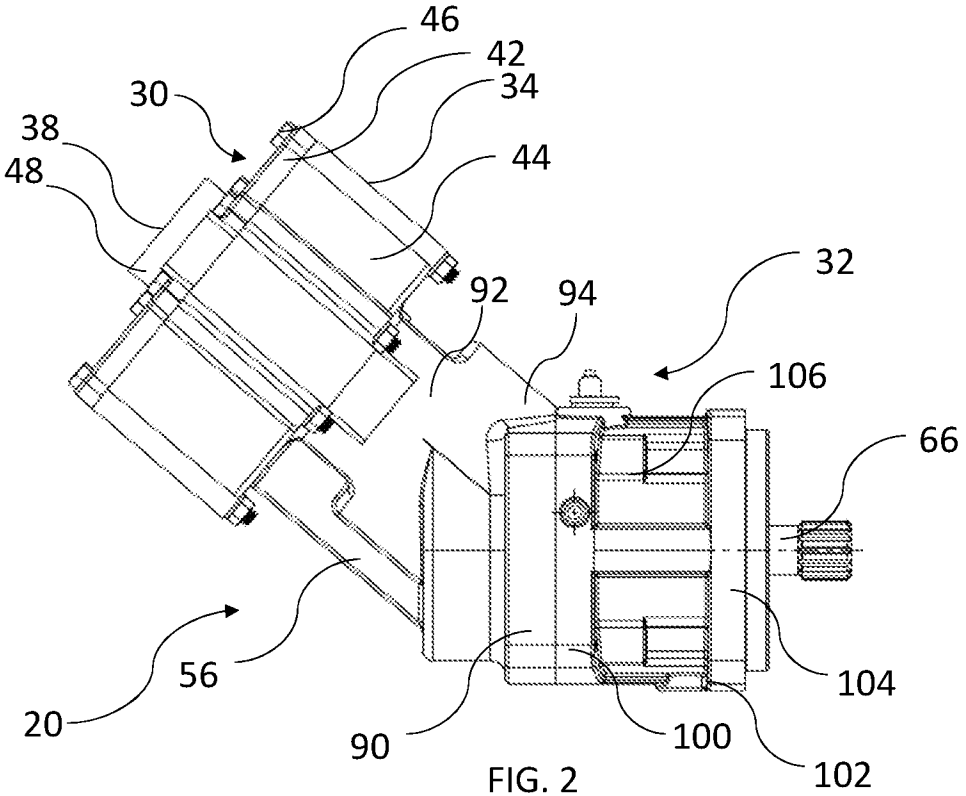
FIG. 2 is a side view of the pump assembly of FIG. 1.
Figure 5:
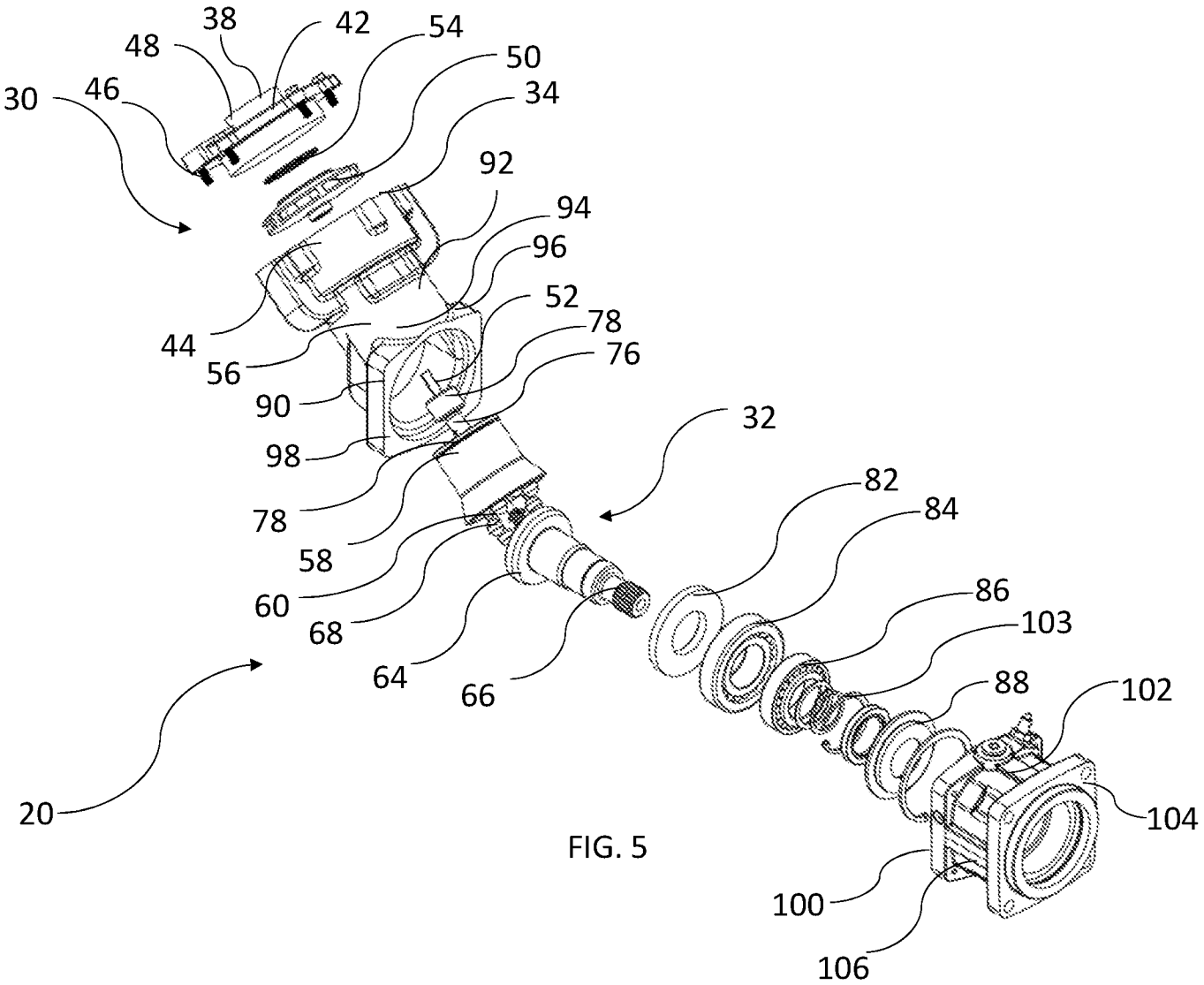
FIG. 5 is an exploded view of the pump assembly of FIG. 1.

As best shown in FIGS. 1, 2 and 5, the cylinder barrel housing 56 may include a flange wall 90 and a cylindrical main body 92. The cylindrical main body 92 may be arranged along the first rotational axis R1 and the flange wall 90 may be arranged along the second rotational axis R2 of the drive shaft 66. Although the flange wall 90 is shown as being rectangular in shape, the flange wall 90 may have any suitable shape. The cylindrical main body 92 may have a protruding lip 94 that extends over a top peripheral surface 96 of the flange wall 90. The main body 44 of the centrifugal pump housing 34 is secured around the cylindrical main body 92. The flange wall 90 has a front face 98 (shown in FIG. 5) that engages with a plate wall 100 of a casing 102 to surround and enclose the assembly components mounted on the drive shaft 66, such as the timing gear 82, the roller bearings 84, 86, the shaft seal 88, and other suitable components such as retaining rings 103. The plate wall 100 is located at a first end of the casing 102 located proximate the centrifugal pump assembly 30 and the casing 102 has a second plate wall 104 that is arranged parallel with the plate wall 100 and at an opposite end of the casing body 106. The casing 102 and the corresponding components housed within the casing 102 are arranged along the second rotational axis R2.

During operation of the pump assembly 20, hydraulic fluid is taken in from a tank or hose through the inlet 38 of the centrifugal pump assembly 30 and the rotating impeller 50 acts as the centrifugal pump. The impeller 50 is rotated by the drive shaft 66 which is driven by a motor that will be described below. The rotation of the impeller 50 provides an increased inlet pressure to the piston assembly, or inlet pressure boost, to one of the bores of the cylinder barrel 58 to pump more flow to the bent axis hydraulic pump assembly 32 without resulting in cavitation. The use of the impeller 50 may eliminate the need for a speed reduction gearbox by allowing the pump assembly 20 to run at high speeds to generate higher flow.

Figure 6:
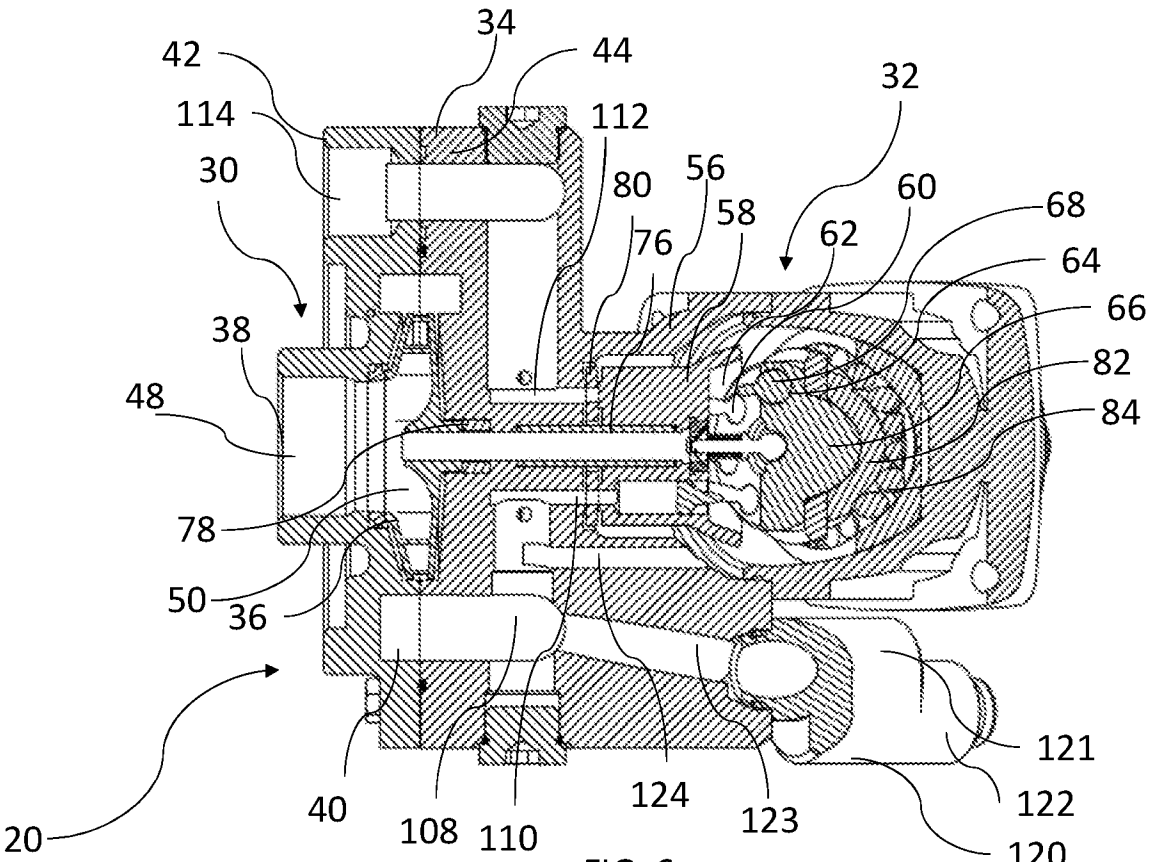
FIG. 6 is a detailed sectional view of the pump assembly of FIG. 1.

As best shown in FIG. 6, the fluid is drawn in to the interior chamber 36 of the centrifugal pump assembly 30 and is accelerated from the center of rotation of the impeller 50 through the outlet 40. The hydraulic fluid flows from the outlet 40 through an adjustable orifice 108 defined within the centrifugal pump housing 34 and a fluid passage 110 that is in fluid communication with a bore of the cylinder barrel 58. The fluid flows through a corresponding slot in the slotted valve plate 76 and into the bore of the cylinder barrel 58. The fluid, having a boost of inlet pressure, is then pumped by the piston 60 and flows outward from the cylinder barrel 58 through a corresponding slot in the slotted valve plate 76 and through a fluid passage 112. The fluid is then discharged from the pump assembly and into the system via a discharge port 114 of the centrifugal pump housing 34 that is in fluid communication with the fluid passage 112.

Figure 8:
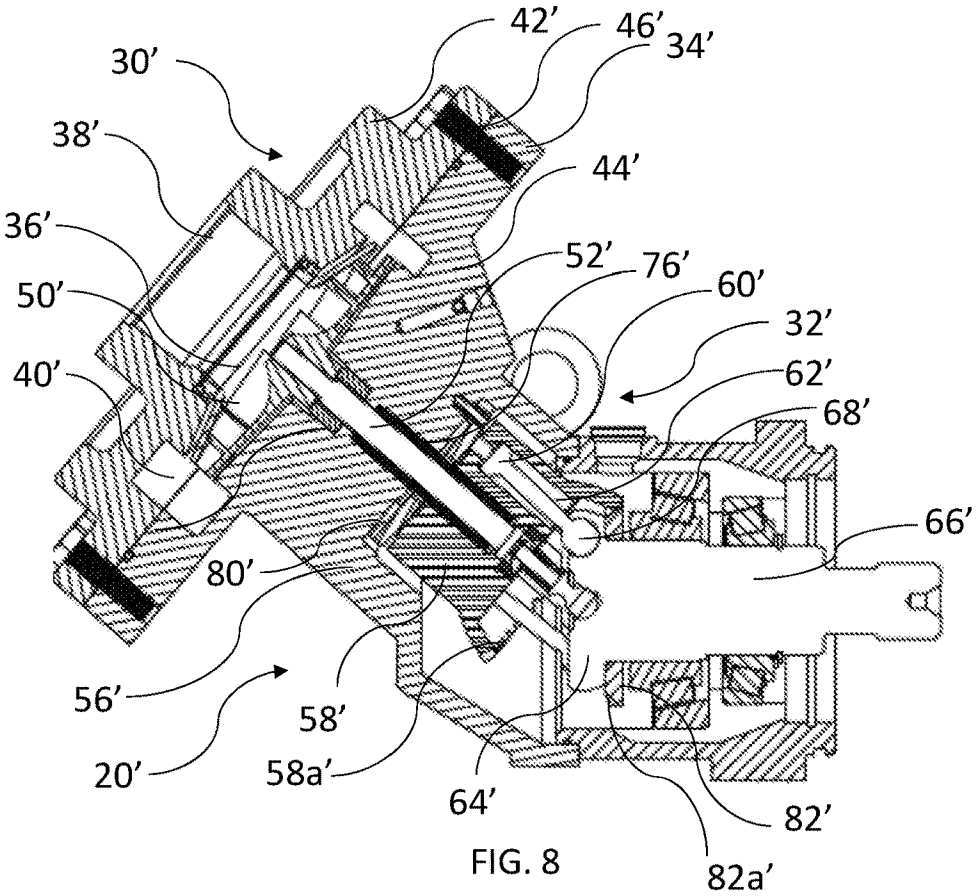
FIG. 8 is a sectional view of the pump assembly of FIG. 7.
Figure 7:
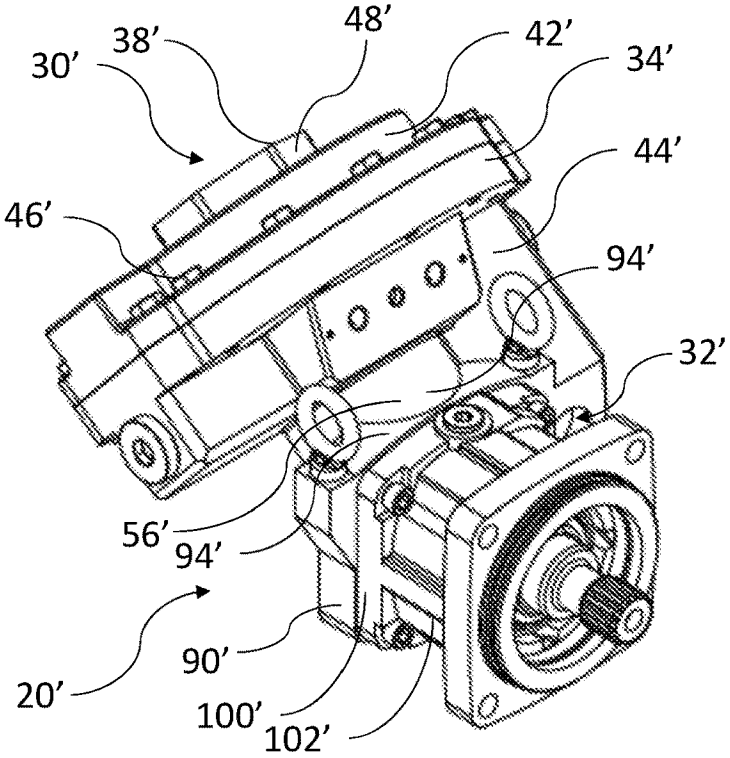
FIG. 7 is a perspective view of a pump assembly housing for a pump assembly having a centrifugal pump and a bent axis hydraulic pump in accordance with a second embodiment.
Figure 9:
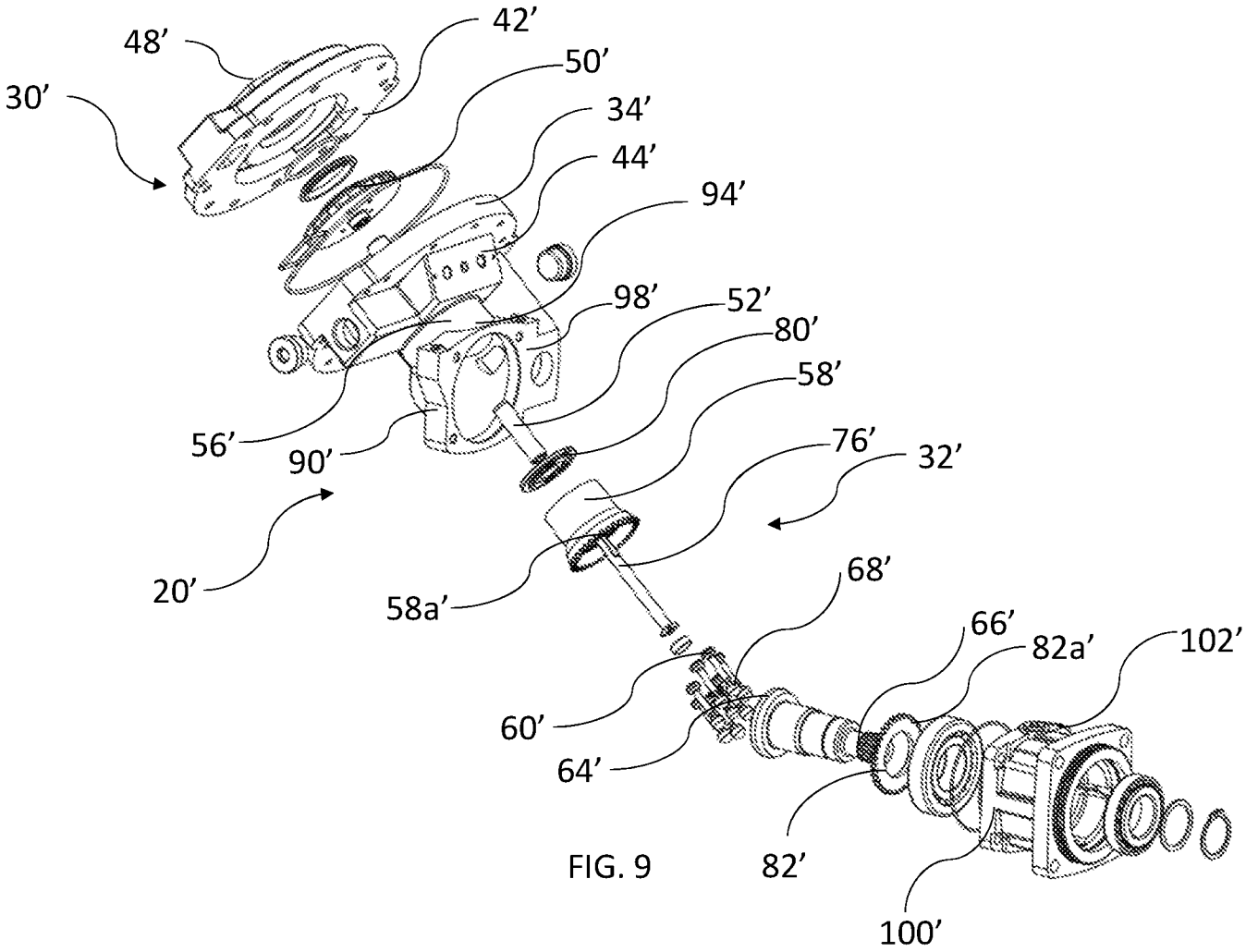
FIG. 9 is an exploded view of the pump assembly of FIG. 7.

Referring now to FIGS. 7-9, another embodiment of the pump assembly 20' is shown. The pump assembly 20' includes the centrifugal pump assembly 30' and the bent axis hydraulic pump assembly 32'. The centrifugal pump assembly 30' includes a centrifugal pump housing 34' having an interior chamber 36', an inlet 38', and an outlet 40'. The centrifugal pump housing 34' includes a volute chamber cover 42' that is secured to a main body 44' of the centrifugal pump housing 34'. The main body 44' defines an interior chamber 36', and the volute chamber cover 42' closes the interior chamber 36'. Portions of the outlet 40' may be defined in both the volute chamber cover 42' and the main body 44' such that the entire outlet 40' is defined when the volute chamber cover 42' is assembled and in contact with the main body 44'. The engaging faces of the volute chamber cover 42' and the main body 44 may be complementary in shape such that the faces are aligned when the centrifugal pump housing 34' is assembled and the faces are engaged. The volute chamber cover 42' may be secured to the end of the main body 44' using bolts 46' or any other suitable fastener. The volute chamber cover 42' may include a cylindrical inlet port 48' that defines the opening to the inlet 38' and extends axially outwardly from the volute chamber cover 42'. The centrifugal pump assembly 30' includes the impeller 50' that is mounted on and rotationally driven by the impeller shaft 52'.

Similar to the embodiment shown in FIGS. 1-6, the bent axis hydraulic pump assembly 32' includes the cylinder barrel housing 56' that is integrated with the centrifugal pump housing 34' and houses a cylinder barrel and piston assembly that is rotationally coupled to the impeller 50'. The cylinder barrel housing 56' includes the cylinder barrel 58'. The bent axis hydraulic pump assembly 32' includes the piston 60' that is received within the bore 62' of the cylinder barrel 58'. The piston 60' is coupled to a flange 64' of the rotatable drive shaft 66' through the ball and socket joint 68'. The cylinder barrel 58' is rotationally coupled to the drive shaft 66' through bevel gears at the ends of the timing gear 82' or teeth 82*a'* along the circumference of the timing gear 82' such that the cylinder barrel and piston assembly is rotationally coupled to the impeller 50' and the drive shaft 66'. The cylinder barrel 58' may have teeth 58*a'* around the circumference of the cylinder barrel 58' that engage with the teeth 82*a'* of the timing gear 82'. The ball and socket joint 68' may secure the piston 60' within the flange 64' of the drive shaft 66'. The impeller shaft 52' extends through the cylinder barrel 58' and is secured to the cylinder barrel 58' for rotation therewith.

The hollow guide pin 76' may be arranged on the impeller shaft 52' and surrounds at least part of the impeller shaft 52'. The guide pin 76' extends through the cylinder barrel 58' and the cylinder barrel housing 56'. The cylinder barrel 58 and piston assembly further includes the slotted valve plate 80' that is arranged in between the cylinder barrel 58' and the cylinder barrel housing 56'. The cylinder barrel housing 56' may include the flange wall 90' and the cylindrical main body 92'. The cylindrical main body 92' may have a protruding lip 94' that extends over a top peripheral surface 96' of the flange wall 90'. The main body 44' of the centrifugal pump housing 34 is secured around the cylindrical main body 92'. The flange wall 90' has the front face 98' that engages with the plate wall 100' of the casing 102' to surround and enclose the assembly components mounted on the drive shaft 66', such as the timing gear 82, the roller bearings, the shaft seal, and other suitable components such as retaining rings. The pump assembly 20' is operable in accordance with the above described operation pertaining to FIGS. 1-6.

Figure 10:
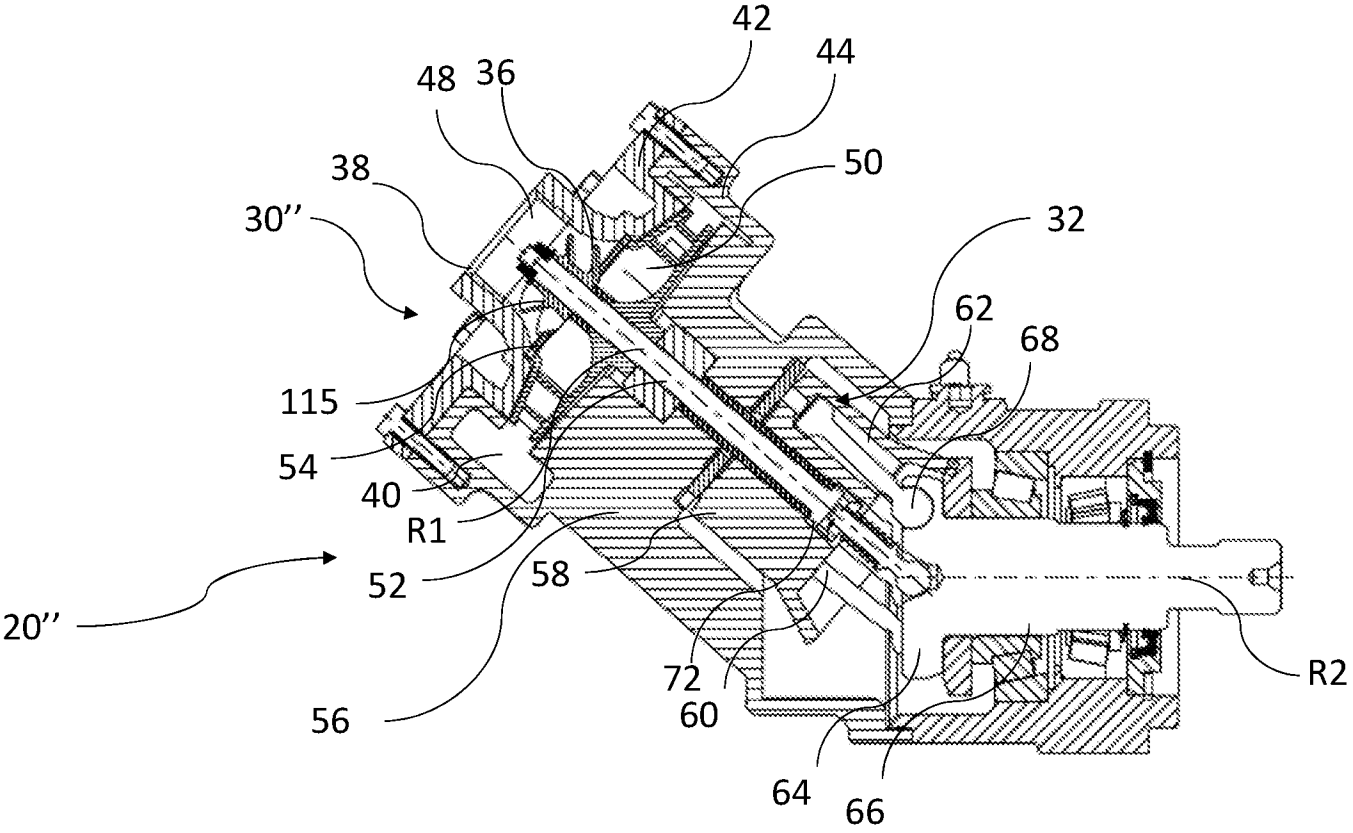
FIG. 10 is a sectional view of the pump assembly of FIG. 1 in accordance with a third embodiment showing the centrifugal pump including an impeller and an inducer.
Figure 11:
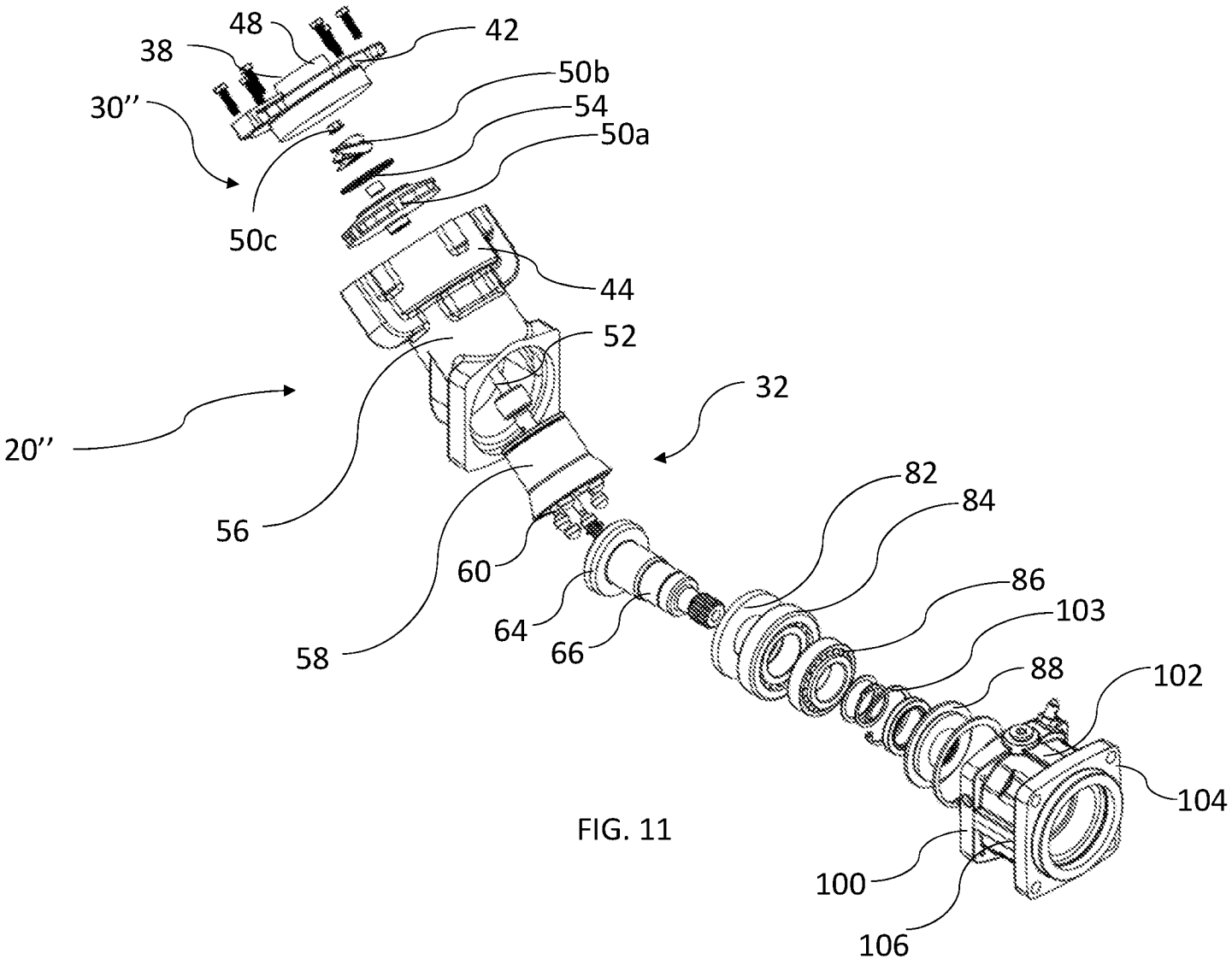
FIG. 11 is an exploded view of the pump assembly of FIG. 10.

The centrifugal pump assembly 30, 30' may include additional components for further increasing pressure on the inlet side of the bent axis hydraulic pump assembly 32. As shown in FIGS. 10 and 11, another embodiment of the pump assembly 20" may include a centrifugal pump assembly 30" having an impeller 50 and an inducer 115 arranged adjacent the impeller within the interior chamber 36. High volatility fluids may vaporize during pumping wherein the eventual collapse of the vapor bubbles will create cavitation that can severely damage the pump components. The inducer 115 provides a pre-boost of the inlet pressure and compresses the gas or vapor in the incoming fluid. The inducer 115 is coupled to the impeller 50 and is driven by the impeller 50. The fluid, now compressed, has a high velocity as well as a higher pressure before it enters the cylinder barrel.

Figure 12:
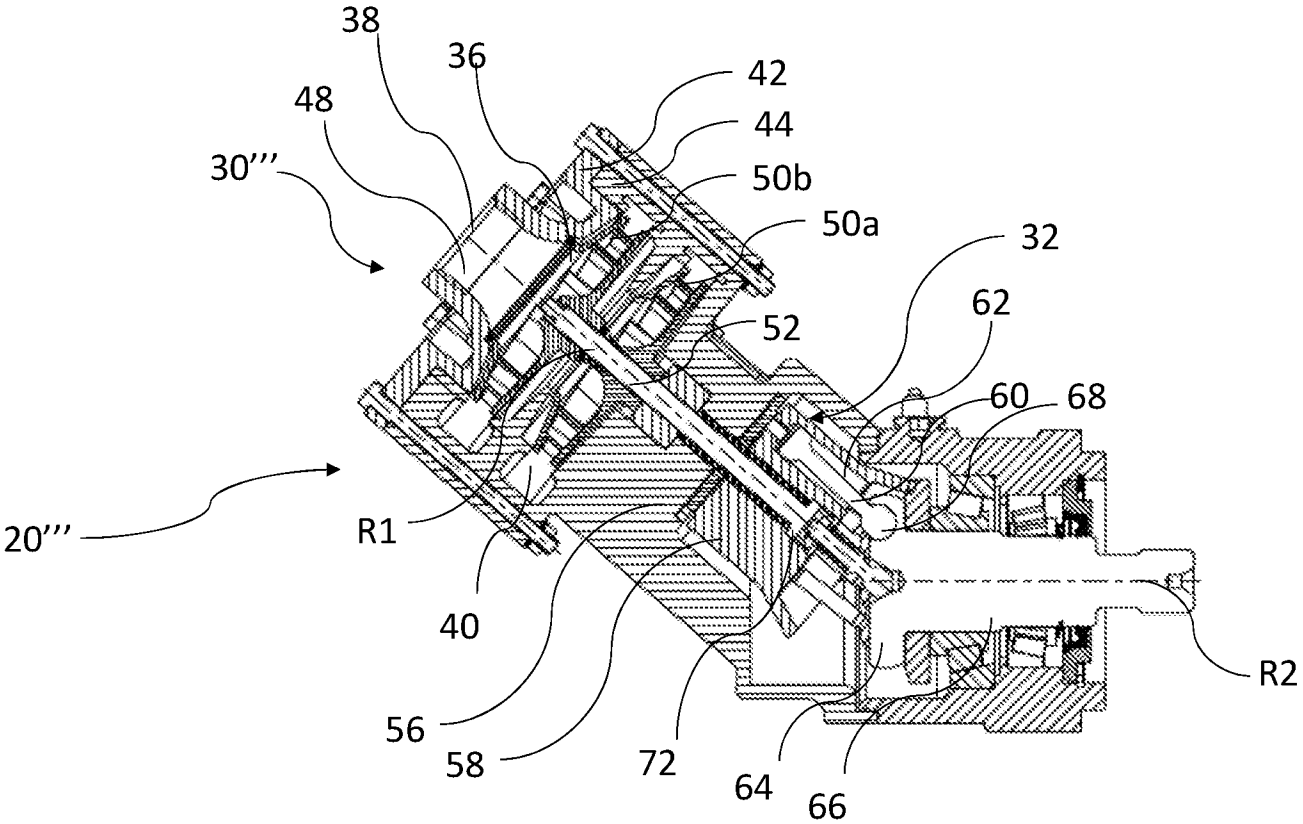
FIG. 12 is a sectional view of the pump assembly of FIG. 1 in accordance with a fourth embodiment showing the centrifugal pump including two impellers.
Figure 13:
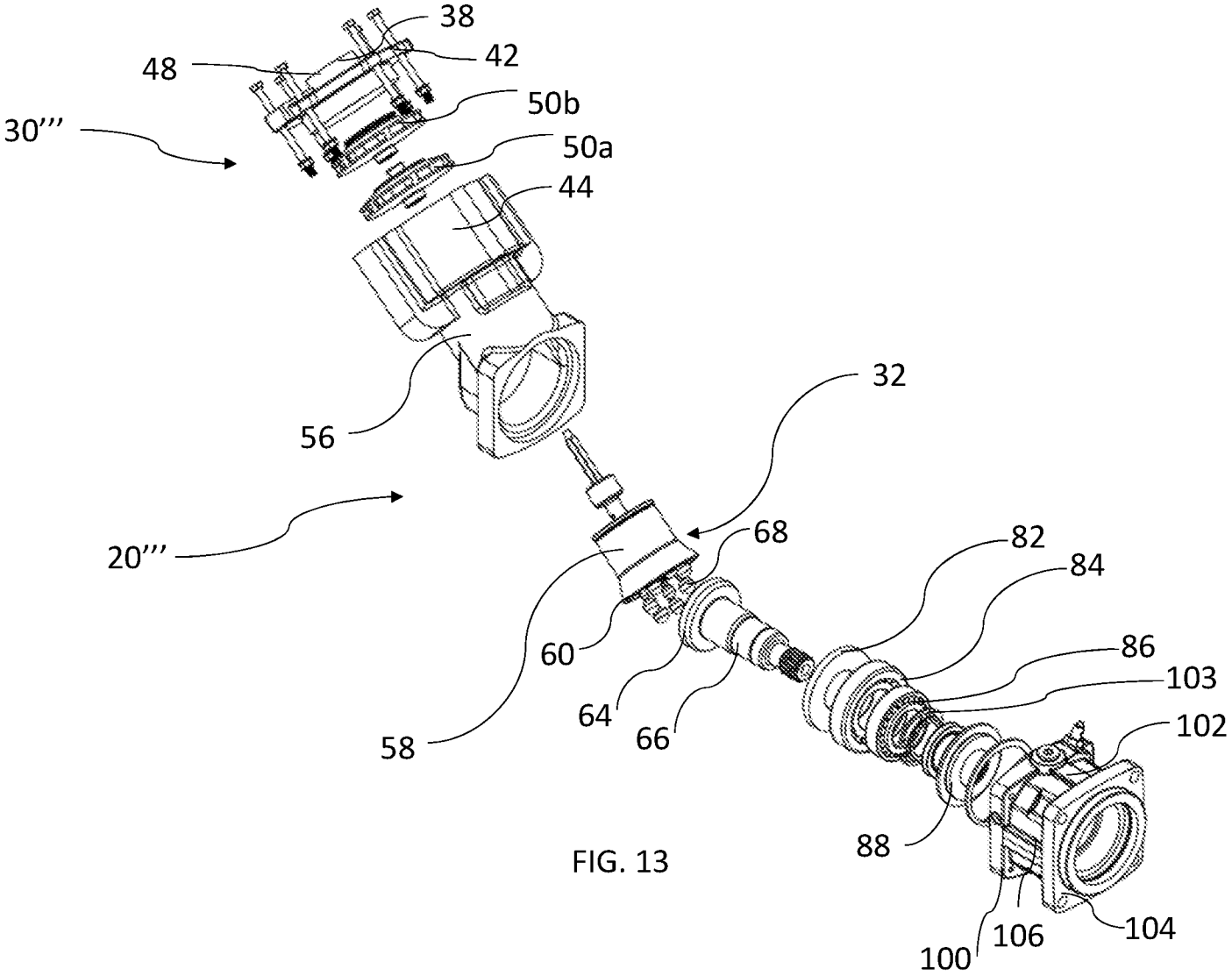
FIG. 13 is an exploded view of the pump assembly of FIG. 12.

As shown in FIGS. 12 and 13, another embodiment of the pump assembly 20'" may include a centrifugal pump assembly 30'" having at least two impellers 50*a*, 50*b* that are arranged adjacent each other within the interior chamber 36. Using two impellers 50*a*, 50*b* may be advantageous in that the two impellers may increase the pre-boost of the inlet pressure as compared with using one impeller. Any suitable number of impellers may be used.

Figure 14:
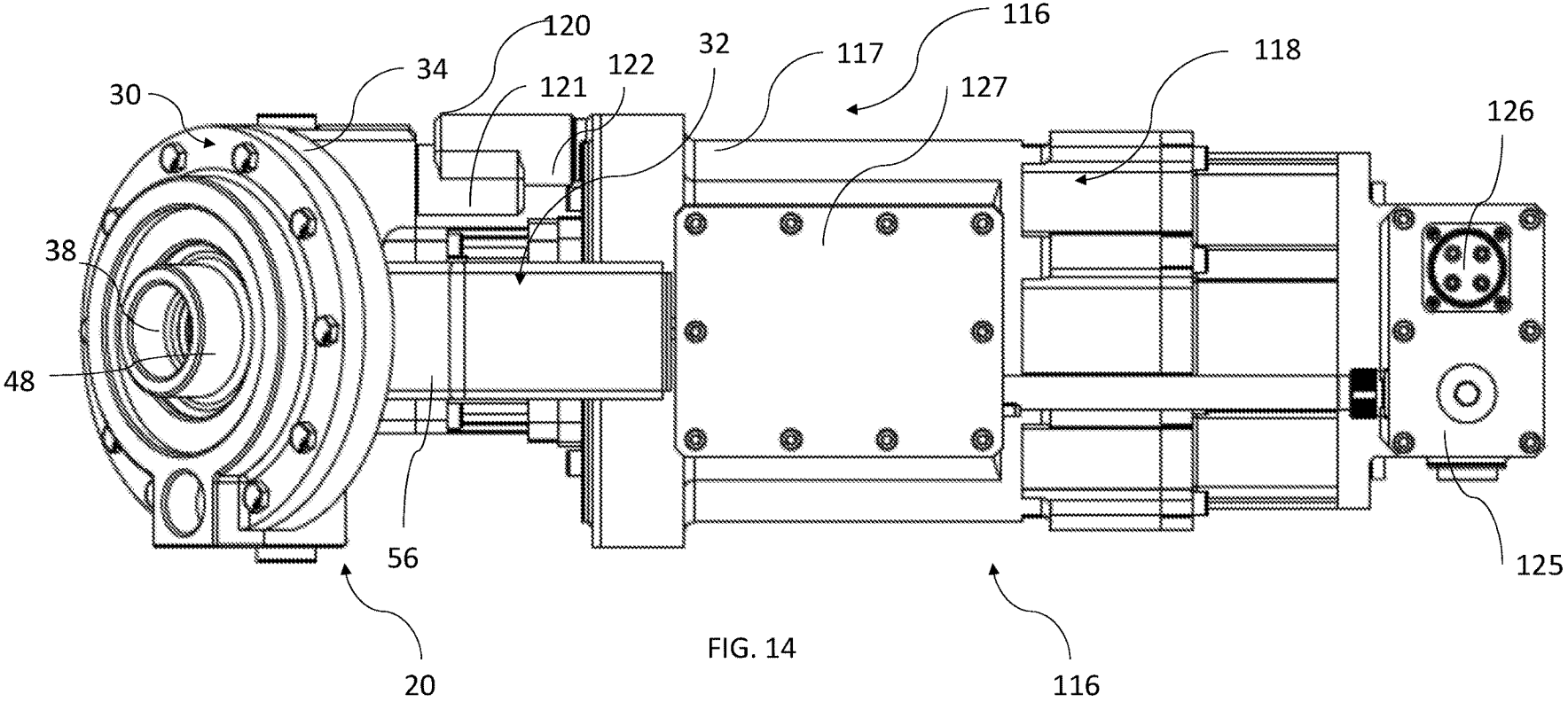
FIG. 14 is a top view of a pump and motor assembly having the pump assembly of FIG. 1 and a motor assembly in accordance with the present invention.
Figure 15:
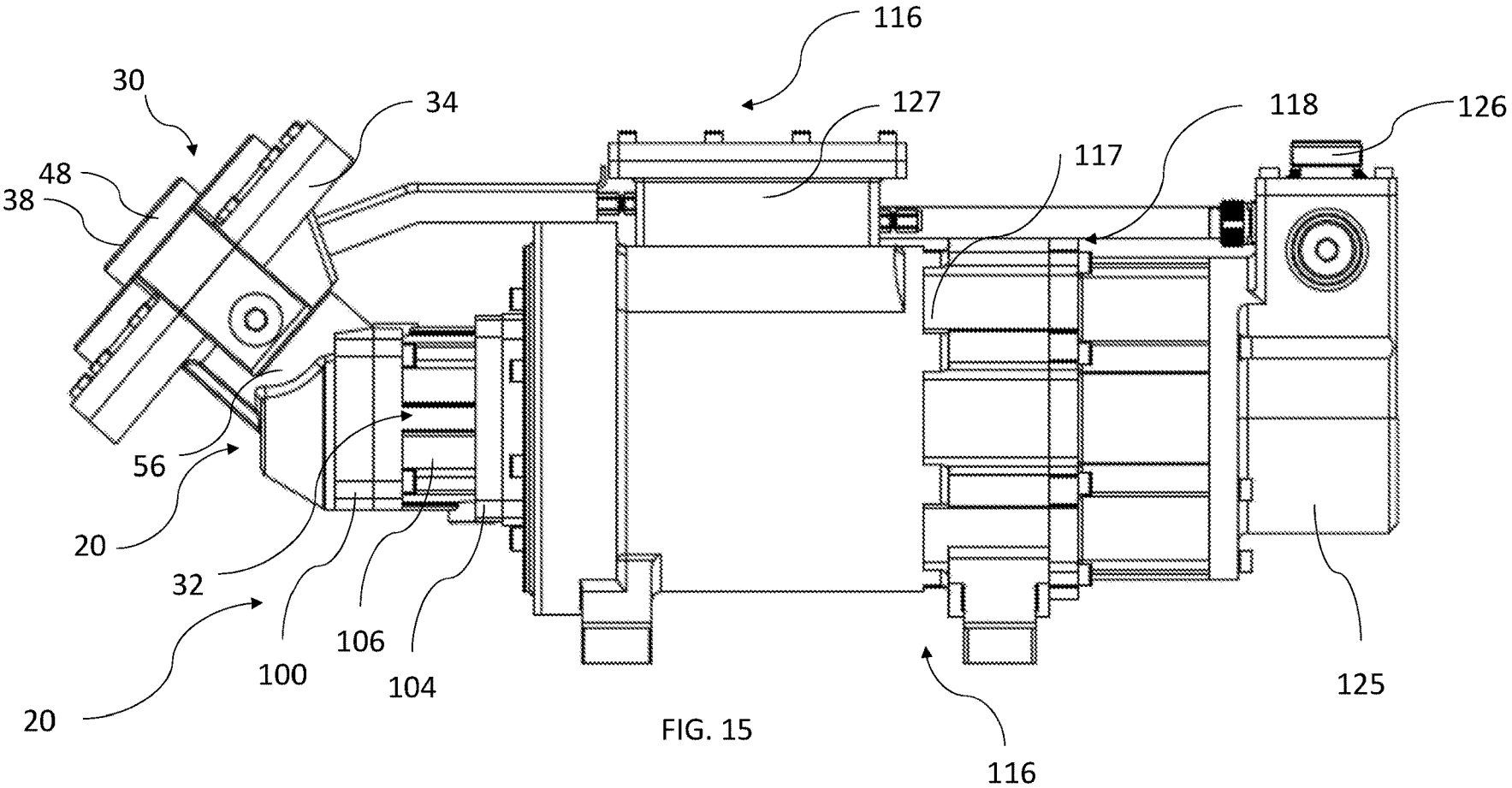
FIG. 15 is a side view of the pump and motor assembly of FIG. 14.
Figure 16:
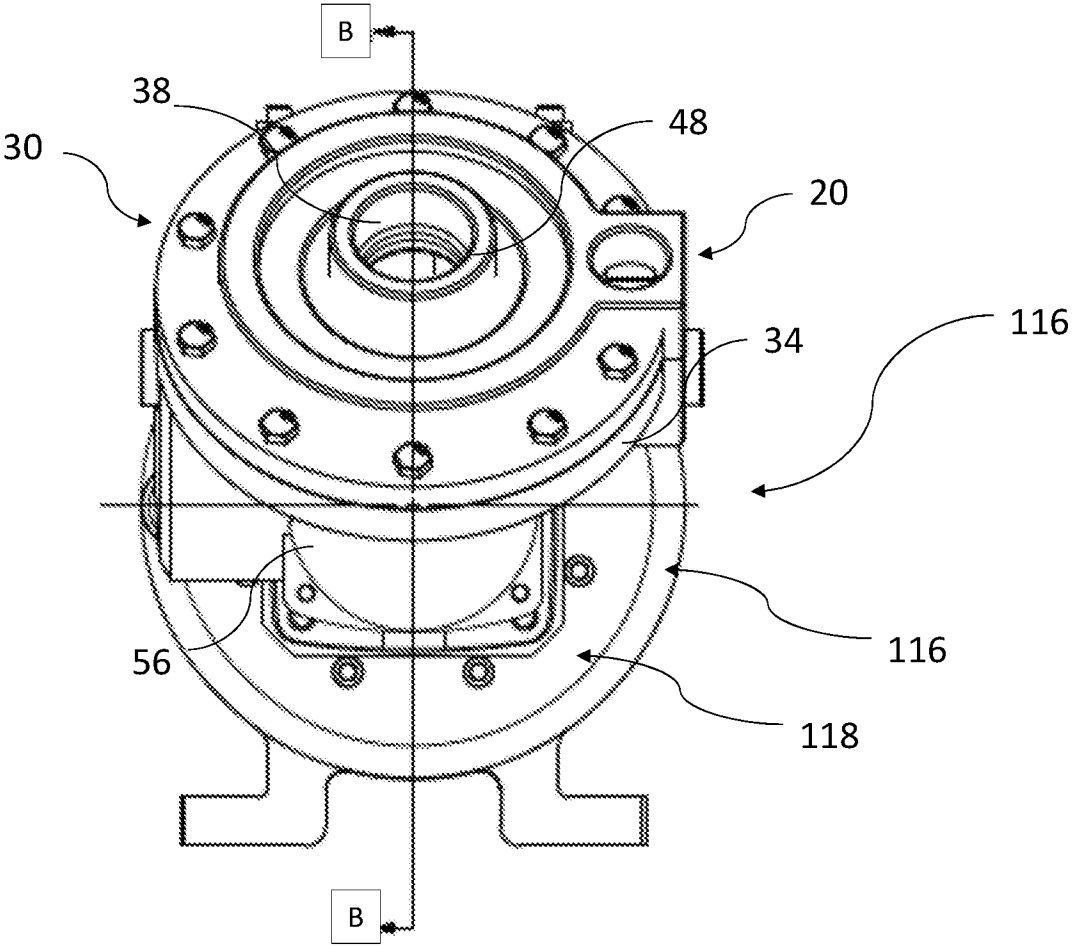
FIG. 16 is a perspective view of the pump and motor assembly of FIG. 14.

With further reference to FIGS. 14-19, a pump and motor assembly 116 may include the above described pump assembly 20, 20', 20", 20'" in conjunction with a drive motor. The pump and motor assembly 116 includes a motor housing 117 that houses a motor assembly 118 for driving the drive shaft 66. As shown in FIGS. 6 and 14, the pump and motor assembly 116 may include a lubrication connector 120 that is connected between the centrifugal pump housing 34 and the motor housing 117. The lubrication connector 120 may be arranged outside of the centrifugal pump housing 34 and may include a first chamber 121 and a second chamber 122 that extend parallel with the axis of the drive shaft 66. Although the lubrication connector 120 is shown outside of the housings for the pump and motor, lubrication paths may alternatively be provided within the housings.

Hydraulic fluid may flow from the outlet 40 of the centrifugal pump assembly 30 through the adjustable orifice 108 (shown in FIG. 6) and to the lubrication connector 120 via a fluid passage 123 defined within the cylinder barrel housing 56. The hydraulic fluid may flow through the lubrication connector 120 toward the motor assembly 118 to provide lubrication and cooling to the motor and the motor components. The lubrication connector 120 may include cylindrical bodies that provide the connecting flow passages between the centrifugal pump housing 34 and the motor housing 117. As further shown in FIG. 6, reverse flow from the motor assembly 118 may be routed through a fluid passage 124 defined in the cylinder barrel housing 56 to the adjustable orifice 108, such that the reverse flow fluid may be re-routed to the lubrication connector 120 and to the cylinder barrel 58.

The motor housing 117 is arranged along the second rotational axis R2 and may be formed of machined high strength aluminum and may be explosion-proof for withstanding high pressure applications. The motor housing 117 includes a connector box 125 that is mounted to the motor housing 117 at an end opposite the bent axis hydraulic pump assembly 32. The connector box 125 may be secured to the motor housing 117 using any suitable method of securement, such as bolts. The connector box 125 may include a hermetically sealed power connector 126 arranged on a top surface of the connector box 125.

The motor assembly 118 further includes a junction box 127 that is connected to the motor and to the centrifugal pump assembly 30. The junction box 127 may be connected to at least one pressure or temperature sensor 128 arranged on the centrifugal pump housing 34. The sensor 128 may be used to monitor the inlet and discharge pressure and temperature of the centrifugal pump assembly 30. The junction box 127 and the connector box 125 may include pressure, speed, and temperature sensors for monitoring the pump and motor assembly 116 remotely. Additionally, the junction box 127 may include a thermal management system. An exemplary junction box and thermal management system is described in International Patent Application Publication Number WO 2017/066091 and incorporated herein by reference.

Figure 17:
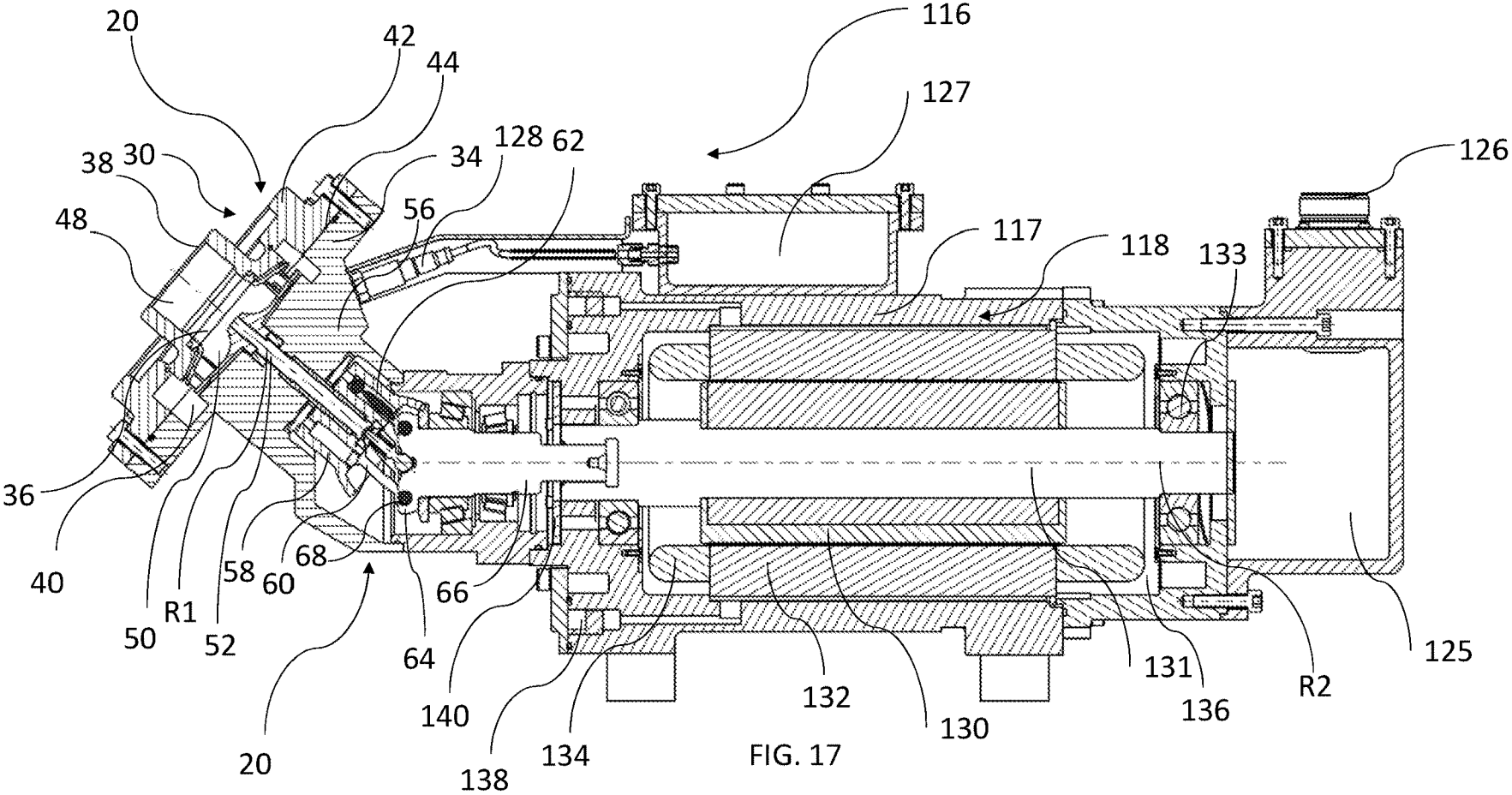
FIG. 17 is a sectional view of the pump and motor assembly taken along line B-B of FIG. 16.
Figure 19:
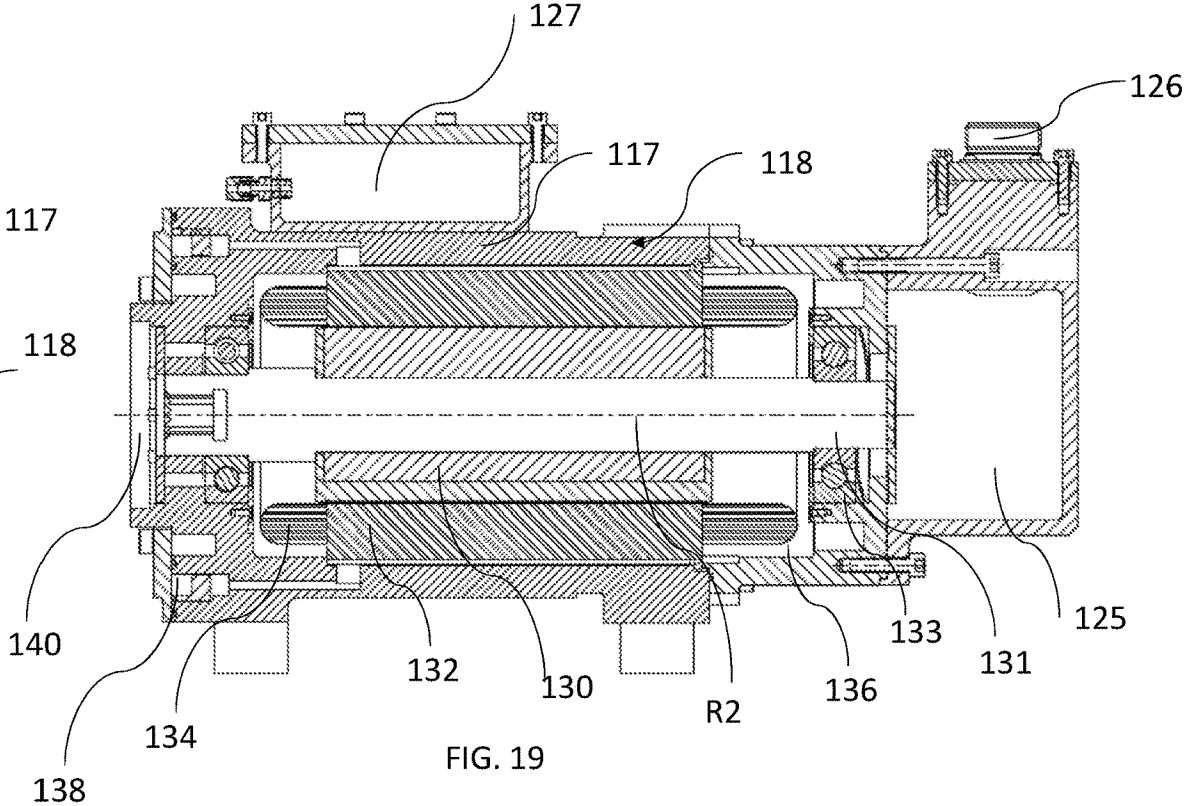
FIG. 19 is a sectional view of the motor assembly taken along line C-C of FIG. 18.
Figure 18:
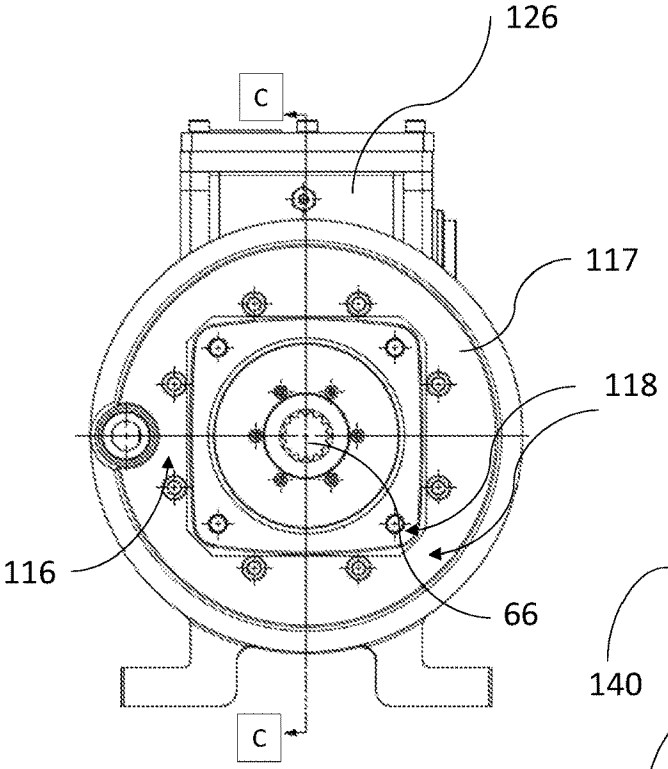
FIG. 18 is a front view of the motor assembly of FIG. 14.

As best shown in FIGS. 17 and 19, the motor is a wet-type electric motor having a rotor 130 that is mounted for rotation with a motor shaft 131 and is rotatable relative to a stator 132 arranged around the rotor 130 and the motor shaft 131. The motor shaft 131 is coupled for rotation with the drive shaft 66. The rotor 130 and the stator 132 are arranged within the motor housing 117 and are fully submerged in hydraulic fluid. The rotor 130 and the stator 132 may be arranged on the drive shaft 66 and interposed between bearings 133. The stator 132 has crescent-shaped slots 134 formed in the outer diameter of the stator 132 that enable hydraulic fluid to enter the motor chamber 136. The slots 134 may have any suitable shape. The motor chamber 136 is defined by the motor housing 117 and contains the rotor 130 and the stator 132. The hydraulic fluid circulates within the motor chamber 136 during operation of the pump and motor assembly 116 such that the rotor 130, the stator 132, bearings 133, and other assembly components are fully lubricated and cooled. The lubrication and cooling flow from the centrifugal pump assembly 30 may enter the motor chamber 136 through a fluid passage 138 defined in the motor housing 117 that is in fluid communication with the outlet 40 of the centrifugal pump assembly 30.

During operation of the centrifugal pump assembly and the bent axis hydraulic pump assembly (the pump side) and the wet motor assembly, hydraulic fluid enters the motor chamber 136 from the pump side of the motor assembly 118 and flows through the motor chamber 136 toward the connector box 122 located at the opposite end of the motor assembly 118 from the pump side. Reverse flow of the hydraulic fluid may occur from the connector box 122 toward the pump side. The hydraulic fluid is circulated through the motor chamber 136 and flows through a gap between the rotor 130 and the stator 132. The fluid may exit the motor housing 117 through an outlet port 140 (shown in FIGS. 17 and 19) that is in communication with the pump side of the entire assembly. The gap between the rotor 130 and the stator 132 may be approximately 0.04 inches. The flow path through the motor is advantageous in providing for maximum cooling and minimal viscous drag through the motor housing 117. The fluid flow holes and stator slots are configured to provide uniform distribution of the lubrication and cooling fluid through the entire motor such that the liquid cooled motor may have a maximum power output of around 100 horsepower.

Referring now to FIGS. 20-25, another embodiment of the pump and motor assembly is a bidirectional bent axis pump assembly 200 that includes a bent axis piston pump as described above and that is also configured for bidirectional flow by providing an additional impeller at the motor side. The bidirectional bent axis pump assembly 200 includes a centrifugal pump assembly 202 and a bent axis hydraulic pump assembly 204 having features that are similar to those previously described. The bidirectional bent axis pump assembly 200 may include any features of the embodiments of the pump and motor assembly as previously described.

As shown in FIGS. 20-23, the centrifugal pump assembly 202 includes a centrifugal pump housing 206 having an interior chamber 208, an inlet 210, and an outlet 212. The centrifugal pump housing 206 further includes a volute chamber cover 214 and an impeller 216 that is mounted on and rotationally driven by an impeller shaft 218 having a rotational axis. The bent axis hydraulic pump assembly 204 includes a cylinder barrel housing 220 that is integrated with the centrifugal pump housing 206 and houses a cylinder barrel and piston assembly that is rotationally coupled to the impeller 216. The bent axis hydraulic pump assembly 204 is arranged along the rotational axis of the impeller 216 and around the impeller shaft 218.

The cylinder barrel housing 220 includes a cylinder barrel 222 that is rotatable about the rotational axis of the impeller 216. The bent axis hydraulic pump assembly 204 includes at least one piston 224 that is received within the cylinder barrel 222, and the bent axis hydraulic pump assembly 204 may include a plurality of pistons. The cylinder barrel 222 includes a bore 225 that receives the piston 224. The cylinder barrel 222 includes at least one bore that is in fluid communication with the outlet 212 of the centrifugal pump assembly 202 and at least one bore that is in fluid communication with a discharge port to discharge the hydraulic fluid from the bidirectional bent axis pump assembly 200 to the surrounding system.

The piston 224 is coupled to a rotatable drive shaft 226 through a ball and socket joint that is rotatable about a second rotational axis. The cylinder barrel 222 is rotationally coupled to the drive shaft 226 through bevel gears at the ends of a timing gear 227 such that the cylinder barrel and piston assembly is rotationally coupled to the impeller 216 and the drive shaft 226. The first rotational axis of the centrifugal pump assembly 202 and the second rotational axis of the drive shaft 226 are angled relative to each other, as previously described with respect to the other embodiments of the pump and motor assembly.

The bidirectional bent axis pump assembly 200 further includes a drive motor assembly 228 that drives the drive shaft 226 through a motor shaft 229 connected to the drive shaft 226 along the second rotational axis of the drive shaft 226. The drive motor assembly 228 includes a motor housing 230 attached to a timing gear housing 231 in which the timing gear 227 is mounted. A junction box and thermal management system 232 as previously described may be arranged on the motor housing 230. The timing gear housing 231 is arranged along the second rotational axis of the drive shaft 226 and connected between the motor housing 230 and the cylinder barrel housing 220. The housings of the components of the bidirectional bent axis pump assembly 200 may be formed integrally or as separate housings that are securely attached to each other to form the entire housing of the pump. The motor includes a rotor 233 that is mounted for rotation with the motor shaft 229 and is rotatable relative to a stator 234 arranged around the rotor 233 and the motor shaft 229. The stator 234 has crescent-shaped slots 235 formed in the outer diameter of the stator 235 that enable hydraulic fluid to enter the motor chamber as previously described.

The bidirectional bent axis pump assembly 200 further includes a discharge port 236 that is arranged at an end of the bidirectional axis pump assembly 200 opposite the inlet 210 of the centrifugal pump assembly 202. As will be described further below, the discharge port 236 is operable as a discharge port for the pump when the bidirectional bent axis pump assembly 200 is in forward flow operation and as an inlet for the pump when the bidirectional bent axis pump assembly 200 is in reverse flow operation.

A motor side impeller 237 is arranged for fluid communication with the discharge port 236. The motor side impeller 237 is provided as a second impeller at the motor side of the bidirectional bent axis pump assembly 200, in addition to the impeller 216 arranged at the pump side. The motor side impeller 237 is connected to the motor shaft 229 and also is mounted along the second rotational axis of the drive shaft 226. The motor side impeller 237 is arranged in an interior chamber 238 defined by the motor housing 230 and a chamber cover 239 in which the discharge port 236 is formed. The motor side impeller 237 is arranged to rotate in an opposite rotational direction relative to the rotational direction of the pump side impeller 216.

As shown in FIGS. 22-25, the bidirectional bent axis pump assembly 200 includes at least one check valve or cooling flow valve, which are used to prevent high pressure fluid flow from reaching the drive motor assembly 228. The bidirectional bent axis pump assembly 200 may include a plurality of cooling flow valves such as a first cooling flow valve 240 arranged in the motor housing 230 and a second cooling flow valve 242 arranged in the timing gear housing 231. Each cooling flow valve 240, 242 may include a poppet 244, a spring 246 that engages the poppet 244, and a removable access plug 248 that enables access to the cooling flow valve 240, 242. The cooling valves 240, 242 may further include a lock ring 249. Each cooling valve 240, 242 has a preset pressure which may be dependent on the application.

The first cooling flow valve 240 is arranged along a motor cooling forward flow path 250 that extends along the length of the bidirectional bent axis pump assembly 200 between the centrifugal pump assembly 202 and the motor side impeller 237. The second cooling flow valve 242 is arranged along a discharge forward flow path 252 that also extends along the length of the bidirectional bent axis pump assembly 200 between the centrifugal pump assembly 202 and the motor side impeller 237. The motor cooling forward flow path 250 and the discharge forward flow path 252 may be formed integrally within the housing of the bidirectional bent axis pump assembly 200. In alternative embodiments, the flow paths may be formed as separate tubing or hoses that are arranged externally to the housing. The flow paths may be arranged radially outwardly relative to the drive shaft 226 and the other components of the bidirectional bent axis pump assembly 200.

Figure 25:
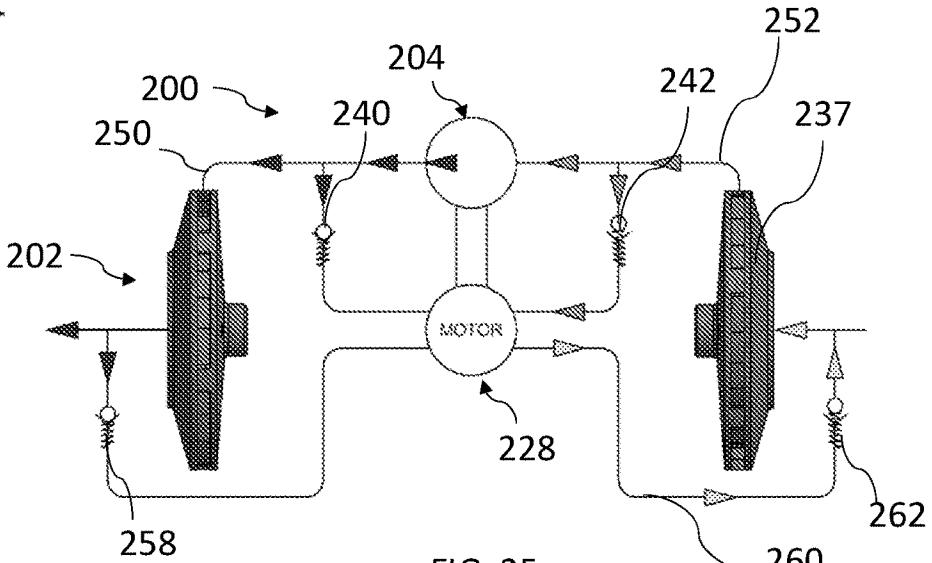
FIG. 25 is a schematic drawing showing operation of the bidirectional bent axis hydraulic pump of FIG. 20 when in reverse flow operation.

The motor cooling forward flow path 250 and the discharge forward flow path 252 are provided to enable the bidirectional bent axis pump assembly 200 to have high fluid flow as the passages are configured to receive high pressure flow. Using the motor cooling forward flow path 250 and the discharge forward flow path 252 enables the bidirectional bent axis pump assembly 200 to have both forward flow operation in which high pressure flow is discharged from the discharge port 236 at the motor side, as schematically shown in FIG. 24, and reverse flow operation in which high pressure flow is discharged from the inlet 210 at the pump side, as schematically shown in FIG. 25.

Figure 22:
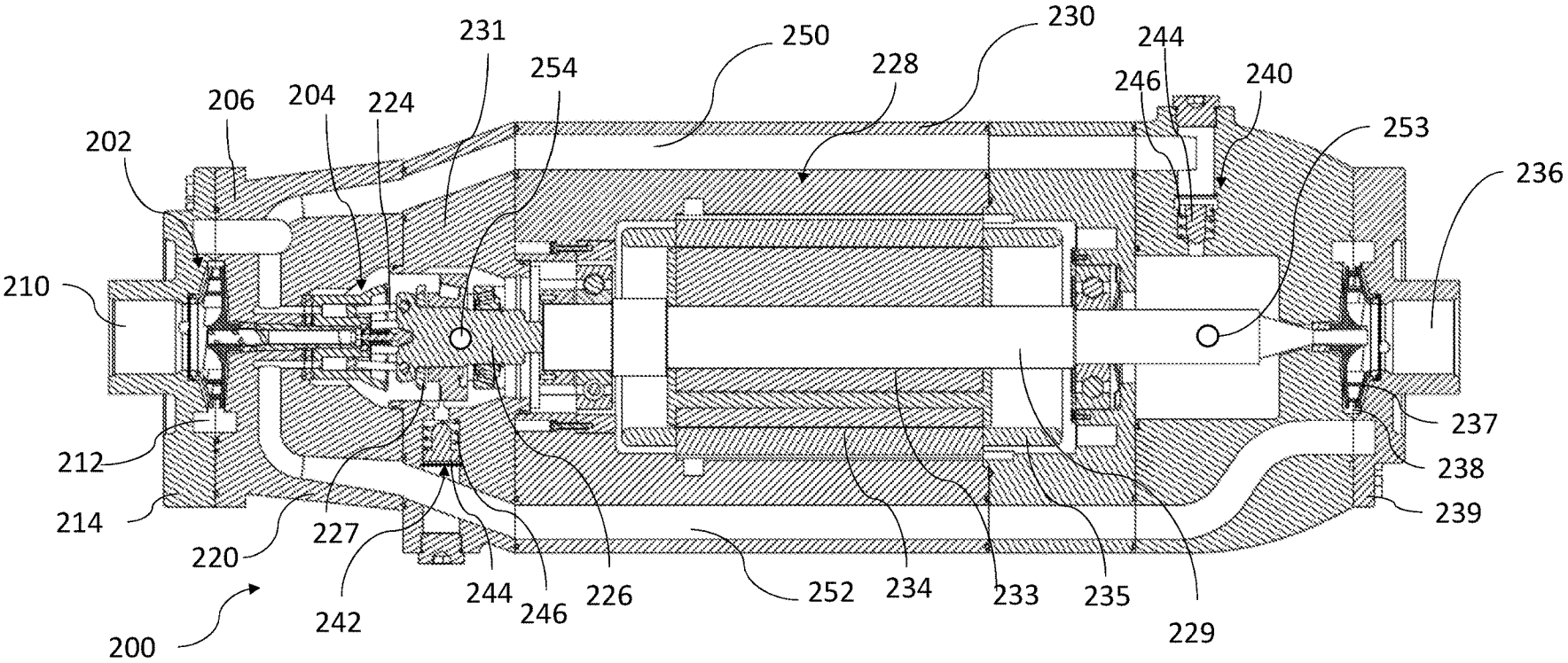
FIG. 22 is a detailed sectional view of the pump assembly of FIG. 20.
Figure 24:
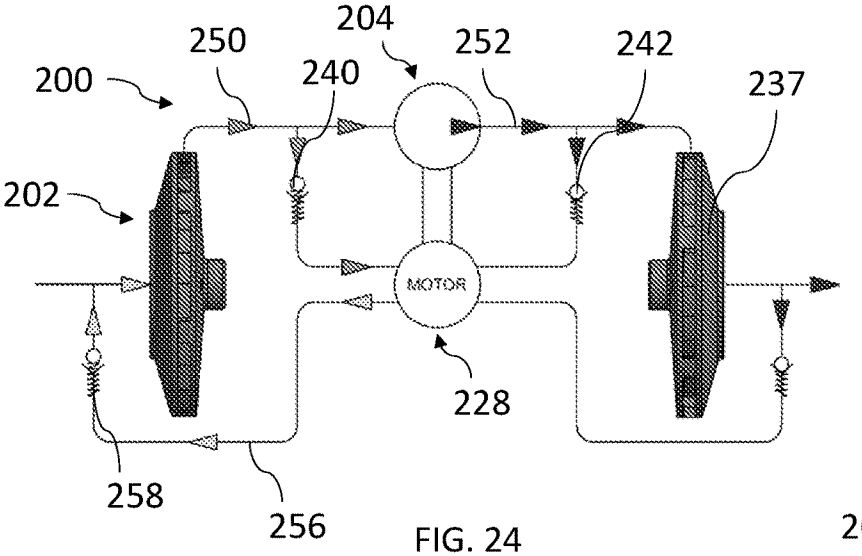
FIG. 24 is a schematic drawing showing operation of the bidirectional bent axis hydraulic pump of FIG. 20 when in forward flow operation.

During the forward flow operation of the bidirectional bent axis pump assembly 200 shown in FIG. 24, a low pressure fluid flows into the inlet 210 of the centrifugal pump assembly 202 where the low pressure fluid is pressure-boosted by the pump side impeller 216. Medium pressure fluid that has a higher pressure than the low pressure fluid is then supplied from the centrifugal pump assembly 202 to both the drive motor assembly 228 and the bent axis hydraulic pump assembly 204. As shown in FIGS. 22 and 24, the medium pressure fluid is supplied to the drive motor assembly 228 through the motor cooling forward flow path 250 and the first cooling flow valve 240. The first cooling flow valve 240 is normally open at lower pressure which enables the medium pressure fluid to flow to the drive motor assembly 228. The medium pressure fluid flows toward a motor side cooling flow point 253, as schematically shown in FIG. 22. The motor side cooling flow point 253 may be formed behind the motor shaft 229.

Figure 20:
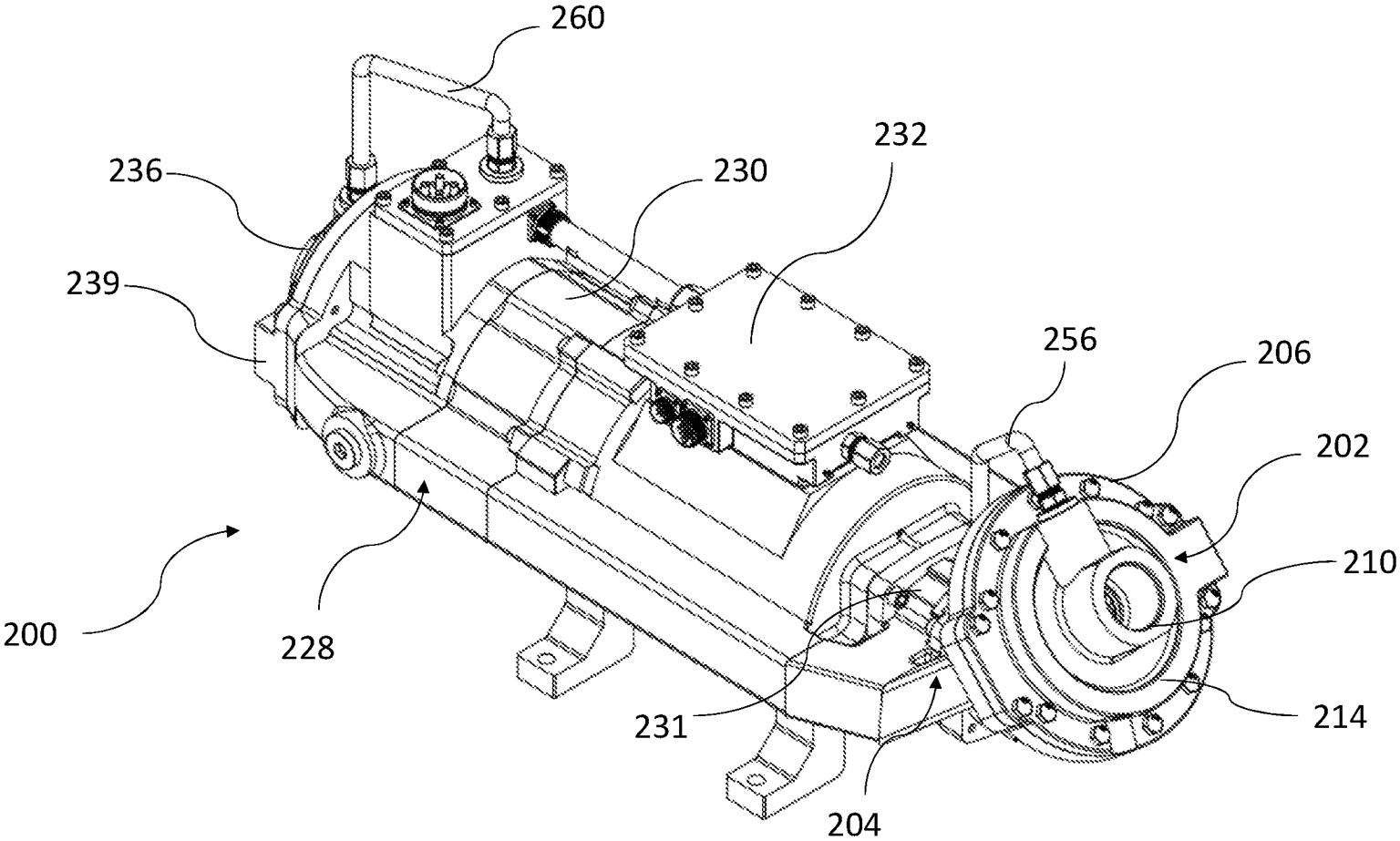
FIG. 20 is a perspective view of a pump assembly housing for a bidirectional bent axis hydraulic pump in accordance with another embodiment.
Figure 21:
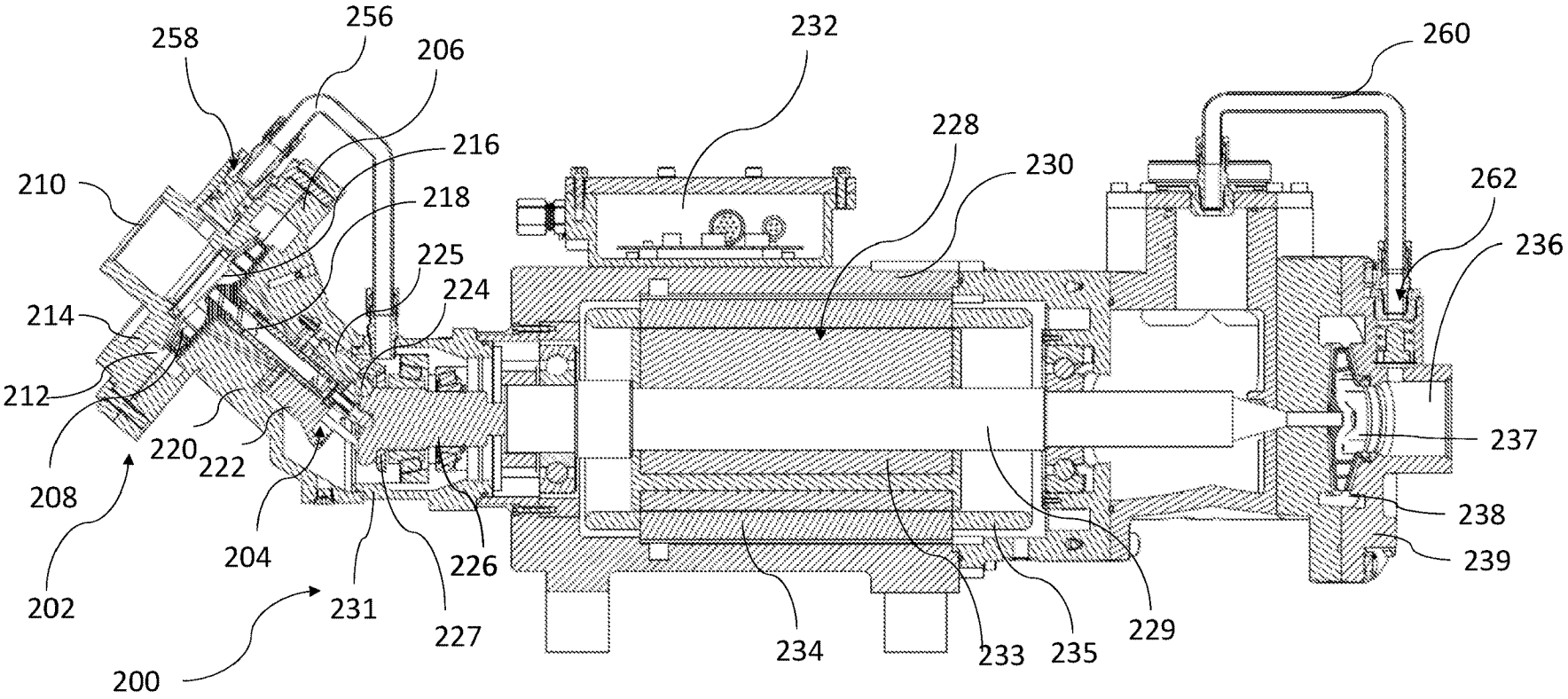
FIG. 21 is a section view of the pump assembly of FIG. 20.
Figure 23:
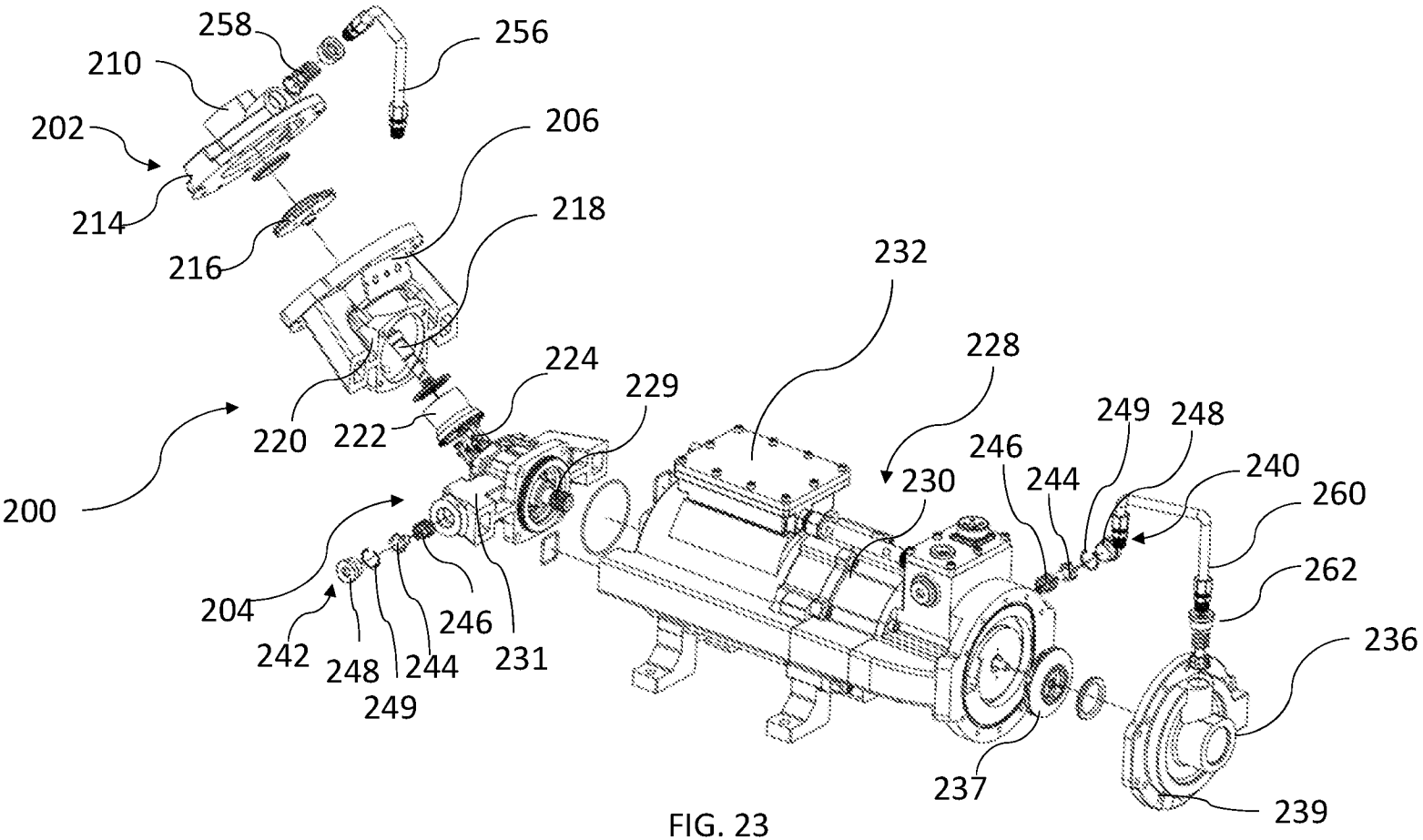
FIG. 23 is an exploded view of the pump assembly of FIG. 20.

The fluid then flows through the motor side cooling flow point 253 across the motor back toward the pump side of the bidirectional bent axis pump assembly 200. The fluid flow proceeds toward a pump side cooling flow point 254 that is arranged in the timing gear housing 231, as schematically shown in FIG. 22. The cooling fluid, which is then a low pressure fluid, flows from the pump side cooling flow point 254 through a flow return line 256 that is in fluid communication between the pump side cooling flow point 254 and the inlet 210 of the centrifugal pump assembly 202, as shown in FIGS. 20, 21 and 23. The flow return line 256 may be formed integrally with the housing of the bidirectional bent axis pump assembly 200 or formed as a tube located externally to the housing. A third cooling flow valve 258 may be arranged between the flow return line 256 and the inlet 210. In an exemplary embodiment, the third cooling flow valve 258 may be arranged in the volute chamber cover 214. The third cooling flow valve 258 is normally open at low pressure such that the low pressure fluid flows through the third cooling flow valve 258 toward the inlet 210 of the bidirectional bent axis pump assembly 200.

The medium pressure fluid generated by the centrifugal pump assembly 202 is also supplied to the bent axis hydraulic pump assembly 204. A high pressure fluid is discharged from the bent axis hydraulic pump assembly 204 through the discharge forward flow path 252 toward the motor side impeller 237, as best shown in FIGS. 22 and 24. The fluid advantageously receives a dual pressure boost by passing through both the pump side impeller 216 and the motor side impeller 237. Due to the motor side impeller 237 being arranged to rotate in an opposite rotational direction as compared with the impeller 216, the motor side impeller 237 acts as a turbine which sucks in the fluid flow. The second cooling flow valve 242 arranged along the discharge forward flow path 252 is in a normally closed position at high pressure such that the high pressure fluid will not flow through the second cooling flow valve 242 and toward the drive motor assembly 228. Thus, the high pressure fluid is prevented from reaching the motor and will flow through the pump side impeller 216 to be discharged through the discharge port 236 at the motor side.

During the reverse flow operation of the bidirectional bent axis pump assembly 200 shown in FIG. 25, a low pressure fluid flows into the bidirectional bent axis pump assembly 200 through the discharge port 236 at the motor side, such that the discharge port 236 acts as an inlet for the bidirectional bent axis pump assembly 200. The low pressure fluid flows through the motor side impeller 237 which provides a pressure boost. The medium pressure fluid generated by the motor side impeller 237 is then routed to the discharge forward flow path 252 through which the fluid flows toward both the drive motor assembly 228 and the bent axis hydraulic pump assembly 204.

The second cooling flow valve 242 arranged along the discharge forward flow path 252 is in a normally open position at a lower pressure that enables the medium pressure fluid to flow through the second cooling flow valve 242. After passing through the second cooling flow valve 242, the medium pressure fluid flows toward the drive motor assembly 228 through the pump side cooling flow point 254, as schematically shown in FIG. 22. The medium pressure fluid then flows across the motor for cooling the motor. The fluid flows toward the motor side cooling flow point 253 at which the medium pressure fluid is a low pressure fluid.

The low pressure fluid flows through the motor side cooling flow point 253 to a flow return line 260. The flow return line 260 may be formed integrally with the housing of the bidirectional bent axis pump assembly 200 or formed as a tube or hose located externally to the housing. A fourth cooling flow valve 262 may be arranged between the flow return line 260 and the discharge port 236. In an exemplary embodiment, the fourth cooling flow valve 262 may be arranged in the chamber cover 239. The fourth cooling flow valve 262 is normally open at low pressure such that the low pressure fluid is returned toward the discharge port 236, i.e. the inlet of the bidirectional bent axis pump assembly 200 when in reverse flow operation.

The medium pressure fluid generated by the motor side impeller 237 is also supplied to the bent axis hydraulic pump assembly 204 from the discharge forward flow path 252. The fluid passes through the bent axis hydraulic pump assembly 204 which generates a high pressure fluid. The high pressure fluid generated by the bent axis hydraulic pump assembly 204 then flows toward the inlet 210, i.e. the discharge port of the bidirectional bent axis pump assembly 200 when in reverse flow operation. The high pressure fluid flows to the centrifugal pump assembly 202 where the fluid advantageously receives another pressure boost by the impeller 216 before exiting the bidirectional bent axis pump assembly 200 through the inlet 210.

The third cooling flow valve 258 is normally closed at high pressure such that the high pressure fluid flows from the centrifugal pump assembly 202 toward the inlet 210 rather than through the third cooling flow valve 258. Additionally, the first cooling flow valve 240 arranged along the motor cooling forward flow path 250 is also normally closed at high pressure such that the high pressure fluid flowing from the bent axis hydraulic pump assembly 204 through the motor cooling forward flow path 250 will not reach the drive motor assembly 228.

The pump and motor assembly according to any of the embodiments described herein is advantageous in that the combination of the centrifugal pump and the bent axis hydraulic pump enables the pump assembly to be run at higher speeds and pump more fluid as compared with previously used pump assemblies for high pressure applications, such as oil and gas refining. Using the impeller provides an inlet pressure boost for the bent axis hydraulic pump, which is runnable at a relatively high speed. For example, the pump and motor assembly may run with flow speeds of around 60 gallons per minute (gpm) and have rotational speeds of around 5600 revolutions per minute (rpm). The pump assembly may discharge pressure at a rate of around 3000 pounds per square inch (psi). Using the impeller and the centrifugal pump assembly enables a pump inlet boost of around 50 psi at 60 gpm.

The pump and motor assembly is further advantageous in that hydraulic fluid is routed from the impeller to the motor housing to provide full and uniform lubrication and cooling of the motor components enabling the motor to run efficiently during the high-speed operation of the pump assembly. The pump and motor assembly may also advantageously be configured for bidirectional high fluid flow, or forward and reverse flow across the pump and motor assembly, by providing a pressure boost in both directions. In the bidirectional pump and motor assembly, the operational characteristics will be similar during both forward flow and reverse flow. The bidirectional pump assembly may be particularly advantageous in applications such as charge tanks.

A pump assembly includes an inlet port, a discharge port, and a centrifugal pump assembly having a housing that defines an interior chamber in fluid communication with the inlet port, an outlet, and an impeller rotatable within the interior chamber. The impeller is connected to a rotatable drive shaft that rotates the impeller and the impeller pumps hydraulic fluid from the inlet port to the outlet. The pump assembly includes a cylinder barrel and piston assembly rotatably coupled to the impeller and the drive shaft. The cylinder barrel and piston assembly is in fluid communication with the outlet of the centrifugal pump assembly and the cylinder barrel and piston assembly pumps hydraulic fluid toward the discharge port. The cylinder barrel and piston assembly and the centrifugal pump assembly are rotatable about a first rotational axis and the drive shaft is rotatable about a second rotational axis. The first rotational axis and the second rotational axis are angled relative to each other.

The cylinder barrel and piston assembly includes a cylinder barrel having at least one bore, at least one piston moveable within the bore, and at least one timing gear. The piston and the cylinder barrel are connected to the drive shaft through the timing gear for rotation with the drive shaft.

The centrifugal pump assembly may include an impeller shaft connected between the impeller and the cylinder barrel, and an impeller shaft guide pin that surrounds at least part of the impeller shaft and extends through the cylinder barrel.

The centrifugal pump assembly may include a bushing spacer mounted on the impeller shaft adjacent the impeller within the interior chamber.

The pump assembly may include an inducer arranged in the interior chamber of the centrifugal pump assembly and the inducer may be interposed between the inlet port and the impeller.

The pump assembly may include at least two impellers arranged in the interior chamber of the centrifugal pump assembly.

The centrifugal pump housing may include a main body that defines the interior chamber and a volute chamber cover that is bolted to the main body.

The pump assembly may include a cylinder barrel housing that is integrated with the centrifugal pump assembly and has a cylindrical main body that is arranged along the first rotational axis of the centrifugal pump assembly and a flange wall that is arranged along the second rotational axis of the drive shaft.

The housing of the centrifugal pump assembly may be secured around the cylindrical main body of the cylinder barrel housing.

The cylindrical main body may have a protruding lip that extends over the flange wall to secure the cylindrical main body to the flange wall.

A pump assembly includes a drive shaft and a centrifugal pump assembly including a centrifugal pump housing having an interior chamber and an impeller that is connected to the drive shaft and rotatable within the interior chamber of the centrifugal pump housing by rotation of the drive shaft. The pump assembly includes a cylinder barrel and piston assembly including a cylinder barrel housing that is integrated with the centrifugal pump assembly, a cylinder barrel rotationally coupled to the impeller, and at least one piston that is moveable within the cylinder barrel and coupled to the drive shaft. The cylinder barrel and piston assembly are in fluid communication with the centrifugal pump housing. The cylinder barrel and piston assembly and the centrifugal pump assembly are rotatable about a first rotational axis and the drive shaft is rotatable about a second rotational axis. The cylinder barrel housing includes a cylindrical main body that is arranged along the first rotational axis and a flange wall that is secured to the cylindrical main body and arranged along the second rotational axis. The first rotational axis and the second rotational axis are angled relative to each other.

The pump assembly may include an impeller shaft connected between the impeller and the cylinder barrel, a guide pin that surrounds at least part of the impeller shaft and extends through the cylinder barrel, and a bushing spacer mounted on the impeller shaft adjacent the impeller within the interior chamber.

The pump assembly may include a plurality of tapered roller bearings arranged on the drive shaft, at least one shaft seal arranged on the drive shaft, and a casing that houses the tapered roller bearings and the shaft seal. The casing may have a wall engageable with the flange wall of the cylinder barrel house.

A pump and motor assembly may include a motor assembly including a motor housing defining a motor chamber, a motor having a rotor and a stator that are arranged within the motor chamber and submerged in hydraulic fluid, and a drive shaft driven by the motor. The pump and motor assembly includes a centrifugal pump assembly including a centrifugal pump housing having an interior chamber, an inlet, and an outlet, an impeller rotatable within the interior chamber of the centrifugal pump housing, wherein the impeller pumps hydraulic fluid from the inlet to the outlet. The pump and motor assembly includes a cylinder barrel and piston assembly rotationally coupled to the impeller and the drive shaft. The cylinder barrel and piston assembly is in fluid communication with the outlet of the centrifugal pump assembly, and the cylinder barrel and piston assembly pumps hydraulic fluid received from the centrifugal pump assembly and discharges the hydraulic fluid. The centrifugal pump assembly and the cylinder barrel and piston assembly are rotatable about a first rotational axis and the drive shaft and the motor assembly are rotatable about a second rotational axis. The first rotational axis and the second rotational axis are angled relative to each other.

The stator may have an outer diameter with a plurality of crescent-shaped slots through which hydraulic fluid flows into the motor chamber.

The pump and motor assembly may include a lubrication connector in fluid communication between the outlet of the centrifugal pump assembly and the motor housing for providing lubrication or cooling flow from the impeller to the motor assembly.

The centrifugal pump assembly may include an adjustable orifice that is fluidly connected between the outlet of the centrifugal pump assembly and the cylinder barrel and piston assembly and the lubrication connector for directing hydraulic fluid to the cylinder barrel and piston assembly and the lubrication connector. The adjustable orifice may be fluidly connected with the motor assembly for receiving hydraulic fluid from the motor and re-directing the hydraulic fluid to the cylinder barrel and piston assembly and the lubrication connector.

The motor assembly may include a junction box arranged on the motor housing and the centrifugal pump assembly includes a pressure or temperature sensor arranged on the centrifugal pump housing for detecting pressure or temperature at the inlet and outlet of the centrifugal pump housing. The junction box may be in communication with the pressure or temperature sensor for monitoring operation of the centrifugal pump assembly.

The pump and motor assembly may include an impeller shaft connected between the impeller and the cylinder barrel and piston assembly, wherein the cylinder barrel and piston assembly is rotationally coupled to the drive shaft and the impeller shaft, a guide pin that surrounds at least part of the impeller shaft and extends through the cylinder barrel and piston assembly, and a bushing spacer mounted on the impeller shaft adjacent the impeller within the interior chamber.

The pump and motor assembly may include a motor side impeller that is in fluid communication with the impeller of the centrifugal pump assembly and rotatable about the second rotational axis in an opposite rotational direction relative to a rotational direction of the impeller of the centrifugal pump assembly, and a discharge port in fluid communication with the motor side impeller. During a forward flow operation of the pump and motor assembly, the inlet of the centrifugal pump assembly is configured to intake a low pressure fluid into the pump and motor assembly and the discharge port is configured to discharge high pressure fluid out of the pump and motor assembly. During a reverse flow operation of the pump and motor assembly, the discharge port of the motor assembly is configured to intake a low pressure fluid into the pump and motor assembly and the inlet of the centrifugal pump assembly is configured to discharge a high pressure fluid out of the pump and motor assembly.

The pump and motor assembly may include a motor cooling forward flow path that is fluidly connected between the centrifugal pump assembly and the motor assembly, and a discharge forward flow path that is fluidly connected between the cylinder barrel and piston assembly and the motor side impeller. During the forward flow operation, the motor cooling forward flow path is configured to receive low pressure fluid flowing from the centrifugal pump assembly to the motor assembly and the discharge forward flow path is configured to receive high pressure fluid flowing from the cylinder barrel and piston assembly to the motor side impeller. During the reverse flow operation, the discharge forward flow path is configured to receive low pressure fluid flowing from the motor side impeller to the cylinder barrel and piston assembly.

The pump and motor assembly may include a first check valve arranged between the motor cooling forward flow path and the motor assembly, the first check valve being in an open position during the forward flow operation and in a closed position during the reverse flow operation, and a second check valve arranged between the discharge forward flow path and the motor assembly, the second check valve being in a closed position during the forward flow operation and in an open position during the reverse flow operation.

The pump and motor assembly may include a first flow return line fluidly connected between the motor assembly and the inlet of the centrifugal pump assembly, a second flow return line fluidly connected between the motor assembly and the discharge port, a third check valve arranged between the flow return line and the inlet of the centrifugal pump assembly, the third check valve being in an open position during the forward flow operation and in a closed position during the reverse flow operation, and a fourth check valve arranged between the second flow return line and the discharge port, the fourth check valve being in a closed position during the forward flow operation and in an position during the reverse flow operation.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A pump and motor assembly comprising:

a motor housing defining a motor chamber, a motor assembly including a motor having a rotor and a stator that are arranged within the motor chamber and submerged in hydraulic fluid, and a drive shaft driven by the motor;

a centrifugal pump assembly including a centrifugal pump housing having an interior chamber, an inlet, and an outlet, an impeller rotatable within the interior chamber of the centrifugal pump housing, wherein the impeller pumps hydraulic fluid from the inlet to the outlet;

a cylinder barrel and piston assembly rotationally coupled to the impeller and the drive shaft, the cylinder barrel and piston assembly being in fluid communication with the outlet of the centrifugal pump assembly, wherein the cylinder barrel and piston assembly pumps hydraulic fluid received from the centrifugal pump assembly and discharges the hydraulic fluid;

wherein the impeller and the cylinder barrel and piston assembly are rotatable about a first rotational axis and the drive shaft and the motor assembly are rotatable about a second rotational axis, the first rotational axis and the second rotational axis being angled relative to each other;

a cylinder barrel housing is integrated with the centrifugal pump assembly, the cylinder barrel housing having a cylindrical main body that is arranged along the first rotational axis of the centrifugal pump assembly and a flange wall that is arranged along the second rotational axis of the drive shaft; and a lubrication connector in fluid communication between the outlet of the centrifugal pump assembly and the motor housing for providing lubrication or cooling flow from the impeller to the motor assembly;

wherein the centrifugal pump assembly includes an adjustable orifice that is fluidly connected between the outlet of the centrifugal pump assembly and the cylinder barrel and piston assembly and the lubrication connector for directing hydraulic fluid to the cylinder barrel and piston assembly and the lubrication connector, the adjustable orifice being fluidly connected with the motor assembly for receiving hydraulic fluid from the motor and re-directing the hydraulic fluid to the cylinder barrel and piston assembly and the lubrication connector.

2. The pump and motor assembly according to claim 1, wherein the stator has an outer diameter with a plurality of crescent-shaped slots through which hydraulic fluid flows into the motor chamber.

3. The pump and motor assembly according to claim 1 further comprising:

an impeller shaft coupled between the impeller and the cylinder barrel and piston assembly, wherein the cylinder barrel and piston assembly is rotationally coupled to the drive shaft and the impeller shaft;

a guide pin that surrounds at least part of the impeller shaft and extends through the cylinder barrel and piston assembly; and a bushing spacer mounted on the impeller shaft adjacent the impeller within the interior chamber.

4. The pump and motor assembly according to claim 1, wherein the motor assembly includes a motor side impeller that is in fluid communication with the impeller of the centrifugal pump assembly and is rotatable about the second rotational axis in an opposite rotational direction relative to a rotational direction of the impeller of the centrifugal pump assembly, and a discharge port in fluid communication with the motor side impeller, wherein during a forward flow operation of the pump and motor assembly, the inlet of the centrifugal pump assembly is configured to intake a low pressure fluid into the pump and motor assembly and the discharge port is configured to discharge high pressure fluid out of the pump and motor assembly, and wherein during a reverse flow operation of the pump and motor assembly, the discharge port of the motor assembly is configured to intake a low pressure fluid into the pump and motor assembly and the inlet of the centrifugal pump assembly is configured to discharge a high pressure fluid out of the pump and motor assembly.

5. The pump and motor assembly according to claim 4 further comprising:

a motor cooling forward flow path that is fluidly connected between the centrifugal pump assembly and the motor assembly; and a discharge forward flow path that is fluidly connected between the cylinder barrel and piston assembly and the motor side impeller, wherein during the forward flow operation, the motor cooling forward flow path is configured to receive low pressure fluid flowing from the centrifugal pump assembly to the motor assembly and the discharge forward flow path is configured to receive high pressure fluid flowing from the cylinder barrel and piston assembly to the motor side impeller, and wherein during the reverse flow operation, the discharge forward flow path is configured to receive low pressure fluid flowing from the motor side impeller to the cylinder barrel and piston assembly.

6. The pump and motor assembly according to claim 5 further comprising:

a first check valve arranged between the motor cooling forward flow path and the motor assembly, the first check valve being in an open position during the forward flow operation and in a closed position during the reverse flow operation; and a second check valve arranged between the discharge forward flow path and the motor assembly, the second check valve being in a closed position during the forward flow operation and in an open position during the reverse flow operation.

7. The pump and motor assembly according to claim 6 further comprising:

a first flow return line fluidly connected between the motor assembly and the inlet of the centrifugal pump assembly;

a second flow return line fluidly connected between the motor assembly and the discharge port;

a third check valve arranged between the flow return line and the inlet of the centrifugal pump assembly, the third check valve being in an open position during the forward flow operation and in a closed position during the reverse flow operation; and a fourth check valve arranged between the second flow return line and the discharge port, the fourth check valve being in a closed position during the forward flow operation and in an open position during the reverse flow operation.

8. The pump and motor assembly according to claim 1, wherein the cylinder barrel and piston assembly includes a cylinder barrel having at least one bore, at least one piston moveable within the bore, and at least one timing gear, wherein the piston and the cylinder barrel are connected to the drive shaft through the timing gear for rotation with the drive shaft.

9. The pump and motor assembly according to claim 8, wherein the centrifugal pump assembly includes an impeller shaft connected between the impeller and the cylinder barrel, and an impeller shaft guide pin that surrounds at least part of the impeller shaft and extends through the cylinder barrel.

10. The pump and motor assembly according to claim 9, wherein the centrifugal pump assembly includes a bushing spacer mounted on the impeller shaft adjacent the impeller within the interior chamber.

11. The pump and motor assembly according to claim 10, further comprising an inducer arranged in the interior chamber of the centrifugal pump assembly, the inducer being interposed between the inlet port and the impeller.

12. The pump and motor assembly according to claim 1, further comprising at least two impellers arranged in the interior chamber of the centrifugal pump assembly.

13. The pump and motor assembly according to claim 1 wherein the housing of the centrifugal pump assembly is secured around the cylindrical main body of the cylinder barrel housing, wherein the cylindrical main body has a protruding lip that extends over the flange wall to secure the cylindrical main body to the flange wall.

14. The pump and motor assembly according to claim 1 further comprising: a plurality of tapered roller bearings arranged on the drive shaft; at least one shaft seal arranged on the drive shaft; and a casing that houses the tapered roller bearings and the shaft seal, the casing having a wall engageable with the flange wall of the cylinder barrel housing.

15. A pump and motor assembly comprising:

a motor housing defining a motor chamber, a motor assembly including a motor having a rotor and a stator that are arranged within the motor chamber and submerged in hydraulic fluid, and a drive shaft driven by the motor;

a centrifugal pump assembly including a centrifugal pump housing having an interior chamber, an inlet, and an outlet, an impeller rotatable within the interior chamber of the centrifugal pump housing, wherein the impeller pumps hydraulic fluid from the inlet to the outlet;

a cylinder barrel and piston assembly rotationally coupled to the impeller and the drive shaft, the cylinder barrel and piston assembly being in fluid communication with the outlet of the centrifugal pump assembly, wherein the cylinder barrel and piston assembly pumps hydraulic fluid received from the centrifugal pump assembly and discharges the hydraulic fluid;

wherein the impeller and the cylinder barrel and piston assembly are rotatable about a first rotational axis and the drive shaft and the motor assembly are rotatable about a second rotational axis, the first rotational axis and the second rotational axis being angled relative to each other; and a cylinder barrel housing is integrated with the centrifugal pump assembly, the cylinder barrel housing having a cylindrical main body that is arranged along the first rotational axis of the centrifugal pump assembly and a flange wall that is arranged along the second rotational axis of the drive shaft;

wherein the motor assembly includes a motor side impeller that is in fluid communication with the impeller of the centrifugal pump assembly and is rotatable about the second rotational axis in an opposite rotational direction relative to a rotational direction of the impeller of the centrifugal pump assembly, and a discharge port in fluid communication with the motor side impeller;

wherein during a forward flow operation of the pump and motor assembly, the inlet of the centrifugal pump assembly is configured to intake a low pressure fluid into the pump and motor assembly and the discharge port is configured to discharge high pressure fluid out of the pump and motor assembly, and wherein during a reverse flow operation of the pump and motor assembly, the discharge port of the motor assembly is configured to intake a low pressure fluid into the pump and motor assembly and the inlet of the centrifugal pump assembly is configured to discharge a high pressure fluid out of the pump and motor assembly.

16. The pump and motor assembly according to claim 15, further comprising:

a motor cooling forward flow path that is fluidly connected between the centrifugal pump assembly and the motor assembly; and a discharge forward flow path that is fluidly connected between the cylinder barrel and piston assembly and the motor side impeller, wherein during the forward flow operation, the motor cooling forward flow path is configured to receive low pressure fluid flowing from the centrifugal pump assembly to the motor assembly and the discharge forward flow path is configured to receive high pressure fluid flowing from the cylinder barrel and piston assembly to the motor side impeller, and wherein during the reverse flow operation, the discharge forward flow path is configured to receive low pressure fluid flowing from the motor side impeller to the cylinder barrel and piston assembly.

17. The pump and motor assembly according to claim 16, further comprising:

a first check valve arranged between the motor cooling forward flow path and the motor assembly, the first check valve being in an open position during the forward flow operation and in a closed position during the reverse flow operation; and a second check valve arranged between the discharge forward flow path and the motor assembly, the second check valve being in a closed position during the forward flow operation and in an open position during the reverse flow operation.

18. The pump and motor assembly according to claim 17, further comprising:

a first flow return line fluidly connected between the motor assembly and the inlet of the centrifugal pump assembly;

a second flow return line fluidly connected between the motor assembly and the discharge port;

a third check valve arranged between the flow return line and the inlet of the centrifugal pump assembly, the third check valve being in an open position during the forward flow operation and in a closed position during the reverse flow operation; and a fourth check valve arranged between the second flow return line and the discharge port, the fourth check valve being in a closed position during the forward flow operation and in an open position during the reverse flow operation.

* * * * *